US007867073B2

(12) United States Patent
Walker et al.

(10) Patent No.: US 7,867,073 B2
(45) **Date of Patent: *Jan. 11, 2011**

(54) ELECTRONIC GAMING DEVICE AND METHOD FOR OPERATING SAME

(75) Inventors: Jay S. Walker, Ridgefield, CT (US); James A. Jorasch, Stamford, CT (US); Magdalena M. Fincham, Norwalk, CT (US); Stephen C. Tulley, Fairfield, CT (US); Geoffrey M. Gelman, Stamford, CT (US)

(73) Assignee: IGT, Reno, NV (US)

( * ) Notice: Subject to any disclaimer, the term of this patent is extended or adjusted under 35 U.S.C. 154(b) by 937 days.

This patent is subject to a terminal disclaimer.

(21) Appl. No.: 10/430,021

(22) Filed: May 5, 2003

(65) Prior Publication Data

US 2003/0199294 A1 Oct. 23, 2003

Related U.S. Application Data

(63) Continuation-in-part of application No. 10/034,695, filed on Dec. 19, 2001, now Pat. No. 6,569,014, which is a continuation of application No. 09/839,854, filed on Apr. 20, 2001, now Pat. No. 6,332,839, which is a continuation of application No. 09/047,577, filed on Mar. 24, 1998, now Pat. No. 6,248,016.

(51) Int. Cl.
*A63F 1/00* (2006.01)

(52) U.S. Cl. ..... 463/13; 273/292

(58) Field of Classification Search ..... 433/174, 433/172, 173, 175, 176, 201.1; 463/13, 16, 463/21; 273/138.1, 292, 303–307
See application file for complete search history.

(56) References Cited

U.S. PATENT DOCUMENTS 4,648,604 A * 3/1987 Horan ..... 273/292

(Continued)

OTHER PUBLICATIONS

"Mikohn Gaming Provides Multi-Site Progressive Jackpot Linking Five Widespread Locations in Las Vegas", PR Newswire, Sep. 6, 1996, Financial News Section.

(Continued)

*Primary Examiner*—Dmitry Suhol
*Assistant Examiner*—Andrew Kim
(74) *Attorney, Agent, or Firm*—K&L Gates LLP

(57) ABSTRACT

A method is provided for facilitating a game of video poker, where a payout may be determined based on aspects of both an initial hand, and a final hand. In one or more embodiments, a payout is determined based on a ranking of an initial hand and a ranking of a final hand. In one or more embodiments, a payout is determined based on cards present in an initial hand and absent from a final hand. In one or more embodiments, a payout is determined based on cards present in a final hand and absent from an initial hand. In one or more embodiments, a payout is determined based on cards present in an initial hand and present in a final hand. In one or more embodiments, a payout is determined based on a probability of generating a final hand from an initial hand. In one or more embodiments, a payout is determined based on an order of cards within an initial hand, final hand, and/or within a set of replacement cards drawn to complete a final hand.

4 Claims, 20 Drawing Sheets

10A00

| | FINAL HAND 10A10 | THE NUMBER OF CARDS PRESENT IN THE INITIAL HAND, AND ABSENT FROM THE FINAL HAND, THAT WOULD HAVE BEEN RELEVANT TO THE RANKING OF THE FINAL HAND 10A12 | | | | | |
|---|---|---|---|---|---|---|---|
| | | PAYOUT 0 CARDS 10A14 | PAYOUT 1 CARD 10A16 | PAYOUT 2 CARDS 10A18 | PAYOUT 3 CARDS 10A20 | PAYOUT 4 CARDS 10A22 | PAYOUT 5 CARDS 10A24 |
| K | ROYAL FLUSH | $800 | N/A | N/A | N/A | N/A | N/A |
| L | STRAIGHT FLUSH | $50 | $60 | $70 | $80 | $90 | $200 |
| M | FOUR OF A KIND | $25 | N/A | N/A | N/A | N/A | N/A |
| N | FULL HOUSE | $9 | $11 | $13 | $20 | N/A | N/A |
| O | FLUSH | $6 | $7 | $8 | $10 | $12 | $40 |
| P | STRAIGHT | $4 | $6 | $8 | $10 | $12 | $30 |
| Q | THREE OF A KIND | $3 | $6 | N/A | N/A | N/A | N/A |
| R | TWO PAIR | $2 | $3 | $4 | $5 | $6 | N/A |
| S | PAIR JACKS OR BETTER | $1 | $2 | $3 | N/A | N/A | N/A |
| T | HIGH CARD/LOW PAIR | $0 | N/A | N/A | N/A | N/A | N/A |

U.S. PATENT DOCUMENTS

| | | | | | |
|---|---|---|---|---|---|
| 4,679,143 | A | | 7/1987 | Hagiwara | 364/412 |
| 4,743,022 | A | | 5/1988 | Wood | 273/85 CP |
| 4,836,553 | A | * | 6/1989 | Suttle et al. | 273/292 |
| 4,926,327 | A | | 5/1990 | Sidley | 364/412 |
| 5,013,049 | A | | 5/1991 | Tomaszewski | 273/292 |
| 5,019,973 | A | | 5/1991 | Wilcox et al. | 364/412 |
| 5,022,653 | A | | 6/1991 | Suttle et al. | 273/85 CP |
| 5,033,744 | A | * | 7/1991 | Bridgeman et al. | 463/13 |
| 5,042,818 | A | | 8/1991 | Weingardt | 273/292 |
| 5,046,735 | A | | 9/1991 | Hamano et al. | 273/85 CP |
| 5,067,724 | A | | 11/1991 | Rinkavage | 273/292 |
| 5,123,649 | A | | 6/1992 | Tiberio | 273/143 R |
| 5,255,915 | A | * | 10/1993 | Miller | 463/13 |
| 5,275,400 | A | | 1/1994 | Weingardt et al. | 273/85 CP |
| 5,294,120 | A | * | 3/1994 | Schultz | 463/13 |
| 5,308,065 | A | | 5/1994 | Bridgeman et al. | 273/85 CP |
| 5,370,339 | A | | 12/1994 | Moody et al. | 242/597.6 |
| 5,370,399 | A | | 12/1994 | Liverance | 273/434 |
| 5,377,903 | A | | 1/1995 | Gordon et al. | 229/116.1 |
| 5,401,023 | A | | 3/1995 | Wood | 273/85 CP |
| 5,415,404 | A | | 5/1995 | Joshi et al. | 273/138 A |
| 5,511,781 | A | | 4/1996 | Wood et al. | 273/85 CP |
| 5,531,440 | A | * | 7/1996 | Dabrowski et al. | 463/12 |
| 5,542,669 | A | | 8/1996 | Charron et al. | 463/13 |
| 5,630,753 | A | | 5/1997 | Fuchs | 463/9 |
| 5,816,914 | A | | 10/1998 | Wichinsky | 463/13 |
| 5,816,916 | A | | 10/1998 | Moody | 463/13 |
| 5,851,148 | A | | 12/1998 | Brune et al. | 463/25 |
| 5,855,515 | A | | 1/1999 | Pease et al. | 463/27 |
| 6,224,055 | B1 | | 5/2001 | Walker et al. | 273/139 |
| 6,248,016 | B1 | | 6/2001 | Walker et al. | 463/13 |
| 6,270,405 | B1 | * | 8/2001 | Ferguson | 463/13 |
| 6,332,839 | B2 | | 12/2001 | Walker et al. | 463/13 |
| 6,371,851 | B1 | | 4/2002 | Singer et al. | 463/13 |
| 6,604,998 | B1 | * | 8/2003 | Singer et al. | 463/13 |

OTHER PUBLICATIONS

Rose, Bob, "New Ways For The House To Win", St Louis Post-Dispatch, Oct. 3, 1996, Get Out Section at p. 50.

"Shuffle Master Begins Immediate Rollout of Five Deck Frenzy and Introduces New Version of Let It Ride; Five Deck Frenzy Video and Let It Ride Bonus Games Successfully Complete Tests", PR Newswire, Jun. 30, 1997, Financial News Section.

Konik, Michael, "The New Games in Vegas", (http://www cigarficionado com), download date: Feb. 1, 1998.

"Review: Five Deck Frenzy", Shuffle Master and IGT, (http://www pitboss com), download date: Feb. 1, 1998.

"Gambling, The Other Progressive", Las Vegas Advisor, Mar. 1998 at p. 8.

Office Action for U.S. Appl. No. 09/047,577, dated Feb. 24, 2000, 7pp.

Office Action for U.S. Appl. No. 09/047,577, dated Mar. 24, 2000, 9pp.

Office Action for U.S. Appl. No. 09/047,577, dated Aug. 23, 2000, 12pp.

Office Action for U.S. Appl. No. 09/047,577, dated Nov. 9, 2000, 5pp.

Notice of Allowability for U.S. Appl. No. 09/047,577, dated Jan. 22, 2001, 5pp.

Office Action for U.S. Appl. No. 09/839,854, dated Aug. 1, 2001, 9pp.

Notice of Allowability for U.S. Appl. No. 09/839,854, dated Oct. 9, 2001, 4pp.

Office Action for U.S. Appl. No. 10/034,695, dated Mar. 6, 2002, 8pp.

Office Action for U.S. Appl. No. 10/034,695, dated Oct. 30, 2002, 3pp.

Office Action for U.S. Appl. No. 10/034,695, dated Jul. 11, 2002, 15pp.

Notice of Allowability for U.S. Appl. No. 10/034,695, dated Jan. 7, 2003. 2pp.

* cited by examiner

10

| | FINAL HAND 15 | PAYOUT 20 |
|---|---|---|
| A | ROYAL FLUSH | $800 |
| B | STRAIGHT FLUSH | $50 |
| C | FOUR OF A KIND | $25 |
| D | FULL HOUSE | $9 |
| E | FLUSH | $6 |
| F | STRAIGHT | $4 |
| G | THREE OF A KIND | $3 |
| H | TWO PAIR | $2 |
| I | ONE PAIR JACKS OR BETTER | $1 |
| J | HIGH CARD/LOW PAIR | $0 |

PRIOR ART

FIG. 1

300

| | FINAL HAND 310 | PAYOUT 0 DRAWN 311 | PAYOUT 1 DRAWN 312 | PAYOUT 2 DRAWN 313 | PAYOUT 3 DRAWN 314 | PAYOUT 4 DRAWN 315 | PAYOUT 5 DRAWN 316 |
|---|---|---|---|---|---|---|---|
| K | ROYAL FLUSH | $1000 | $500 | $600 | $1000 | $2000 | $5000 |
| L | STRAIGHT FLUSH | $75 | $50 | $60 | $80 | $100 | $150 |
| M | FOUR OF A KIND | $50 | $20 | $25 | $25 | $30 | $40 |
| N | FULL HOUSE | $15 | $7 | $8 | $9 | $10 | $12 |
| O | FLUSH | $9 | $5 | $7 | $9 | $12 | $15 |
| P | STRAIGHT | $7 | $3 | $4 | $7 | $9 | $12 |
| Q | THREE OF A KIND | $4 | $3 | $3 | $4 | $5 | $7 |
| R | TWO PAIR | $2 | $2 | $2 | $2 | $2 | $2 |
| S | PAIR JACKS OR BETTER | $1 | $1 | $1 | $1 | $1 | $1 |
| T | HIGH CARD/LOW PAIR | $0 | $0 | $0 | $0 | $0 | $0 |

FIG. 3

7A00

| | FINAL HAND 7A10 | THE NUMBER OF CARDS RELEVANT TO THE RANKING OF THE FINAL HAND THAT WERE NOT PRESENT IN THE INITIAL HAND 7A12 | | | | | |
|---|---|---|---|---|---|---|---|
| | | PAYOUT 0 CARDS 7A14 | PAYOUT 1 CARDS 7A16 | PAYOUT 2 CARDS 7A18 | PAYOUT 3 CARDS 7A20 | PAYOUT 4 CARD 7A22 | PAYOUT 5 CARDS 7A24 |
| K | ROYAL FLUSH | $800 | $900 | $1000 | $2500 | $4000 | $5000 |
| L | STRAIGHT FLUSH | $35 | $40 | $50 | $60 | $75 | $75 |
| M | FOUR OF A KIND | $20 | $25 | $30 | $50 | $50 | N/A |
| N | FULL HOUSE | $7 | $8 | $10 | $13 | $15 | $15 |
| O | FLUSH | $3 | $4 | $5 | $7 | $9 | $9 |
| P | STRAIGHT | $2 | $3 | $4 | $5 | $7 | $7 |
| Q | THREE OF A KIND | $2 | $3 | $4 | $4 | N/A | N/A |
| R | TWO PAIR | $1 | $2 | $2 | $2 | $2 | N/A |
| S | PAIR JACKS OR BETTER | $1 | $1 | $1 | N/A | N/A | N/A |
| T | HIGH CARD/LOW PAIR | $0 | N/A | N/A | N/A | N/A | N/A |

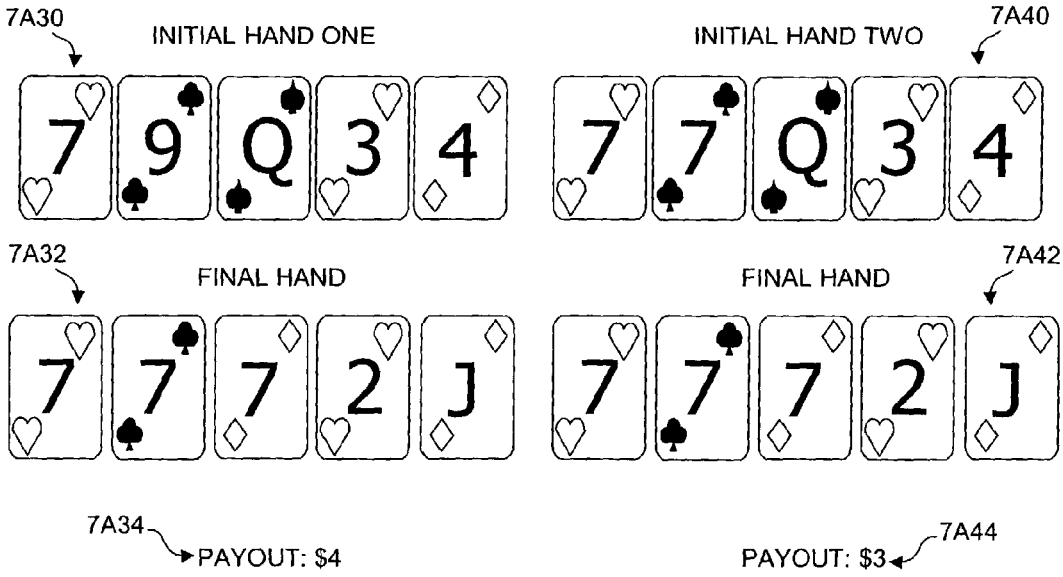

FIG. 7A

8A00

| | FINAL HAND 8A10 | INITIAL HAND RANKING 8A12 | | | | |
|---|---|---|---|---|---|---|
| | | HIGH CARD/ LOW PAIR 8A14 | PAIR JACKS OR BETTER 8A16 | | STRAIGHT FLUSH 8A18 | ROYAL FLUSH 8A20 |
| K | ROYAL FLUSH | $2000 | $1700 | | $700 | $600 |
| L | STRAIGHT FLUSH | $55 | $50 | | $40 | N/A |
| M | FOUR OF A KIND | $35 | $30 | | $25 | N/A |
| N | FULL HOUSE | $12 | $10 | | $9 | N/A |
| O | FLUSH | $8 | $7 | | $6 | N/A |
| P | STRAIGHT | $5 | $5 | | $4 | N/A |
| Q | THREE OF A KIND | $4 | $3 | | $3 | N/A |
| R | TWO PAIR | $2 | $2 | | $2 | N/A |
| S | PAIR JACKS OR BETTER | $1 | $1 | | $1 | N/A |
| T | HIGH CARD/LOW PAIR | $0 | $0 | | $0 | N/A |

8A30 INITIAL HAND ONE

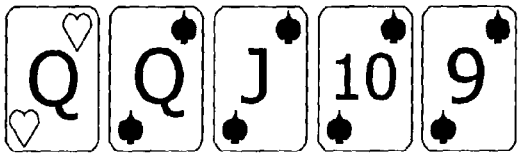

8A32 FINAL HAND

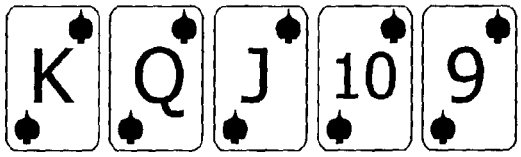

8A34 PAYOUT: $50

INITIAL HAND TWO 8A40

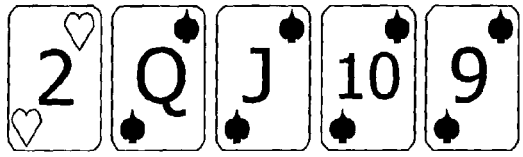

FINAL HAND 8A42

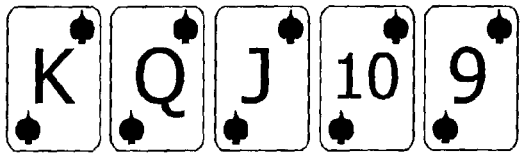

PAYOUT: $55 8A44

FIG. 8A

9A00

| | FINAL HAND 9A10 | INITIAL HAND RANKING: HIGH CARD/ LOW PAIR 9A13 | PAYING CARD COMBINATION PRESENT IN THE INITIAL HAND AND ABSENT FROM THE FINAL HAND 9A12 | | | | |
|---|---|---|---|---|---|---|---|
| | | | PAIR JACKS OR BETTER 9A14 | TWO PAIR 9A16 | THREE OF A KIND 9A18 | STRAIGHT 9A20 | |
| K | ROYAL FLUSH | $800 | $850 | $900 | $2000 | $2100 | |
| L | STRAIGHT FLUSH | $50 | $50 | $52 | $54 | $55 | |
| M | FOUR OF A KIND | $25 | $28 | $30 | $35 | $45 | |
| N | FULL HOUSE | $9 | $12 | $15 | $20 | $25 | |
| O | FLUSH | $6 | $6 | $8 | $10 | $11 | |
| P | STRAIGHT | $4 | $4 | $6 | $8 | $9 | |
| Q | THREE OF A KIND | $3 | $4 | $5 | $7 | $8 | |
| R | TWO PAIR | $2 | $2 | $2 | $2 | $3 | |
| S | PAIR JACKS OR BETTER | $1 | $1 | $2 | $2 | $3 | |
| T | HIGH CARD/LOW PAIR | $0 | $0 | $0 | $1 | $2 | |

9A30 INITIAL HAND ONE

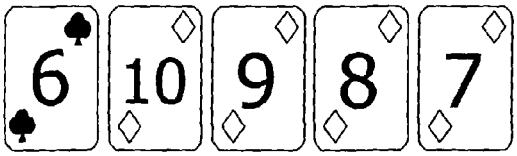

9A32 FINAL HAND

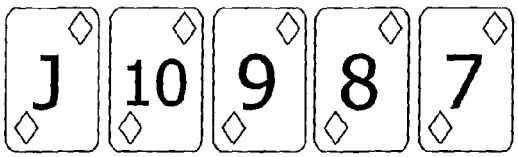

9A34 PAYOUT: $55

INITIAL HAND TWO 9A40

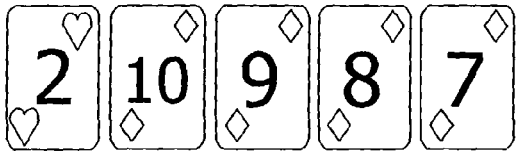

FINAL HAND 9A42

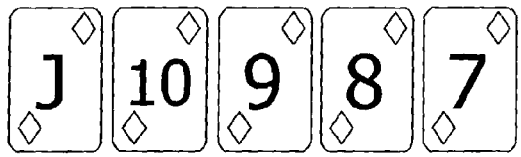

PAYOUT: $50 9A44

FIG. 9A

10A00

| | FINAL HAND 10A10 | THE NUMBER OF CARDS PRESENT IN THE INITIAL HAND, AND ABSENT FROM THE FINAL HAND, THAT WOULD HAVE BEEN RELEVANT TO THE RANKING OF THE FINAL HAND 10A12 | | | | | |
|---|---|---|---|---|---|---|---|
| | | PAYOUT 0 CARDS 10A14 | PAYOUT 1 CARD 10A16 | PAYOUT 2 CARDS 10A18 | PAYOUT 3 CARDS 10A20 | PAYOUT 4 CARDS 10A22 | PAYOUT 5 CARDS 10A24 |
| K | ROYAL FLUSH | $800 | N/A | N/A | N/A | N/A | N/A |
| L | STRAIGHT FLUSH | $50 | $60 | $70 | $80 | $90 | $200 |
| M | FOUR OF A KIND | $25 | N/A | N/A | N/A | N/A | N/A |
| N | FULL HOUSE | $9 | $11 | $13 | $20 | N/A | N/A |
| O | FLUSH | $6 | $7 | $8 | $10 | $12 | $40 |
| P | STRAIGHT | $4 | $6 | $8 | $10 | $12 | $30 |
| Q | THREE OF A KIND | $3 | $6 | N/A | N/A | N/A | N/A |
| R | TWO PAIR | $2 | $3 | $4 | $5 | $6 | N/A |
| S | PAIR JACKS OR BETTER | $1 | $2 | $3 | N/A | N/A | N/A |
| T | HIGH CARD/LOW PAIR | $0 | N/A | N/A | N/A | N/A | N/A |

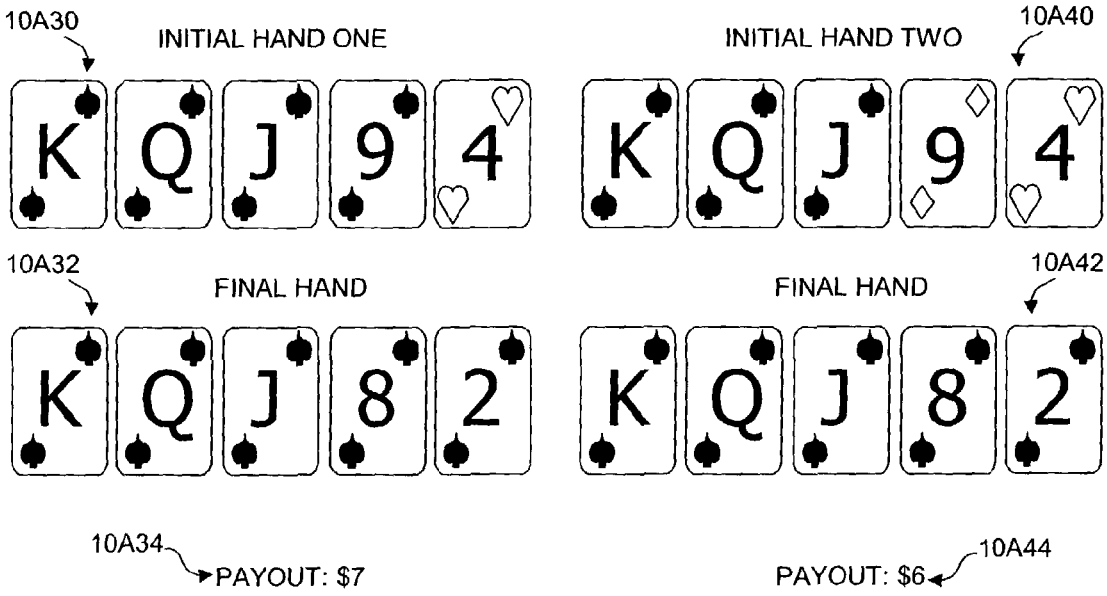

FIG. 10A

11A00

| | FINAL HAND 11A10 | PROBABILITY OF ACHIEVING THE FINAL HAND FROM THE INITIAL HAND, USING THE PLAYER'S STRATEGY 11A12 | | | | | |
|---|---|---|---|---|---|---|---|
| | | PAYOUT 1 11A14 | PAYOUT 2.13E-2 11A16 | PAYOUT 9.25E-4 11A18 | PAYOUT 6.17E-5 11A20 | PAYOUT 5.61E-6 11A22 | PAYOUT 6.52E-7 11A24 |
| K | ROYAL FLUSH | $700 | $800 | $900 | $1000 | $1200 | $1500 |
| L | STRAIGHT FLUSH | $45 | $50 | $55 | $60 | $70 | $80 |
| M | FOUR OF A KIND | $20 | $25 | $28 | $33 | $37 | $45 |
| N | FULL HOUSE | $8 | $9 | $9 | $10 | $11 | $13 |
| O | FLUSH | $5 | $6 | $7 | $9 | $10 | $11 |
| P | STRAIGHT | $3 | $4 | $4 | $5 | $5 | $6 |
| Q | THREE OF A KIND | $2 | $3 | $3 | $3 | $4 | $4 |
| R | TWO PAIR | $2 | $2 | $2 | $2 | $2 | $2 |
| S | PAIR JACKS OR BETTER | $1 | $1 | $1 | $1 | $1 | $1 |
| T | HIGH CARD/LOW PAIR | $0 | $0 | $0 | $0 | $0 | $0 |

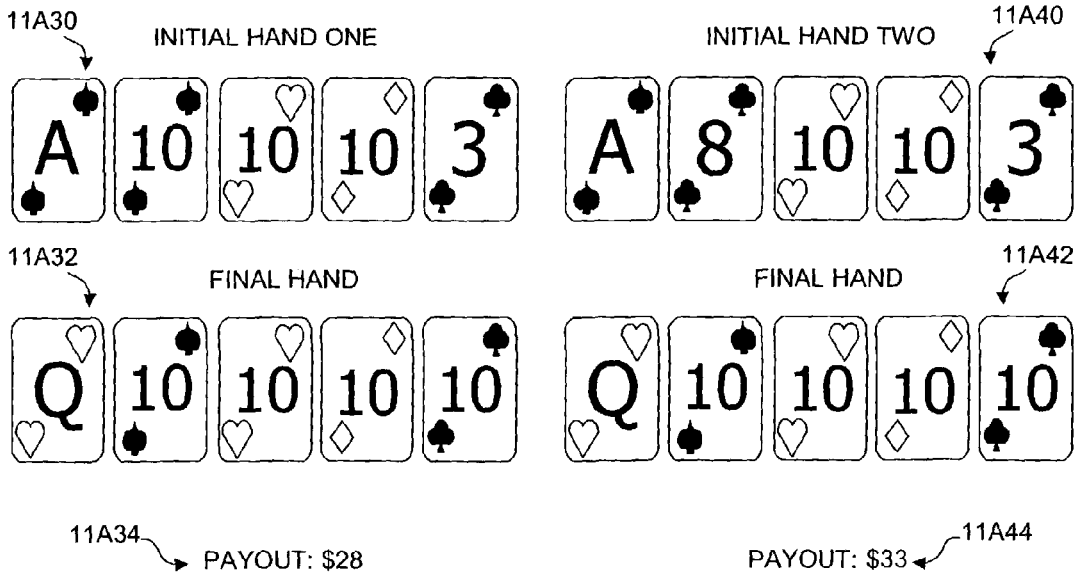

FIG. 11A

12A00

| | FINAL HAND 12A10 | PROBABILITY RANGE OF ACHIEVING ANY HAND OF THE SAME RANKING AS THE FINAL HAND FROM THE INITIAL HAND, USING THE PLAYER'S STRATEGY 12A12 | | | | |
|---|---|---|---|---|---|---|
| | | PAYOUT 1 12A14 | PAYOUT 0.3-1 12A16 | PAYOUT 0.04-0.3 12A18 | PAYOUT 0.035-0.04 12A20 | PAYOUT 0.03-0.035 12A22 |
| K | ROYAL FLUSH | $800 | $800 | $800 | $800 | $800 |
| L | STRAIGHT FLUSH | $50 | $50 | $55 | $55 | $55 |
| M | FOUR OF A KIND | $25 | $25 | $25 | $25 | $25 |
| N | FULL HOUSE | $9 | $9 | $10 | $10 | $10 |
| O | FLUSH | $6 | $6 | $6 | $6 | $7 |
| P | STRAIGHT | $4 | $4 | $5 | $5 | $5 |
| Q | THREE OF A KIND | $3 | $3 | $4 | $4 | $4 |
| R | TWO PAIR | $2 | $2 | $2 | $2 | $2 |
| S | PAIR JACKS OR BETTER | $1 | $1 | $1 | $1 | $1 |
| T | HIGH CARD/LOW PAIR | $0 | $0 | $0 | $0 | $0 |

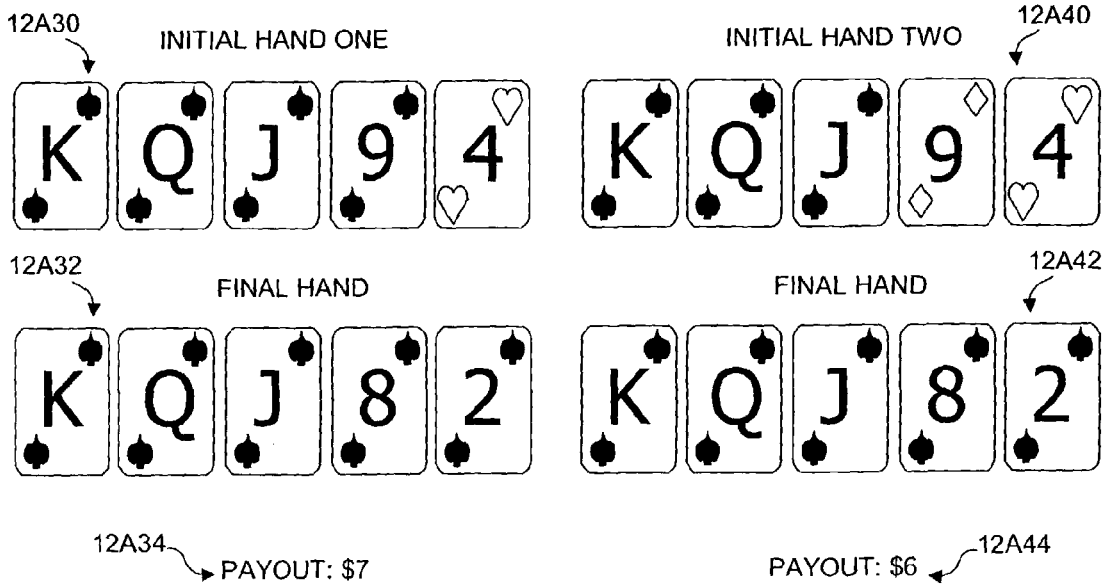

FIG. 12A

13A00

| | FINAL HAND 13A10 | THE NUMBER OF CARDS IN THE LARGEST GROUP OF CARDS IN THE INITIAL HAND OCCURRING IN ASCENDING RANK ORDER GOING FROM LEFT TO RIGHT 13A12 | | | | |
|---|---|---|---|---|---|---|
| | | PAYOUT 1 CARD 13A14 | PAYOUT 2 CARDS 13A16 | PAYOUT 3 CARDS 13A18 | PAYOUT 4 CARDS 13A20 | PAYOUT 5 CARDS 13A22 |
| K | ROYAL FLUSH | $1000 | $800 | $750 | $800 | $1000 |
| L | STRAIGHT FLUSH | $60 | $50 | $40 | $50 | $60 |
| M | FOUR OF A KIND | $30 | $25 | $25 | $25 | $30 |
| N | FULL HOUSE | $10 | $9 | $9 | $9 | $10 |
| O | FLUSH | $7 | $6 | $5 | $6 | $7 |
| P | STRAIGHT | $5 | $4 | $3 | $4 | $5 |
| Q | THREE OF A KIND | $4 | $3 | $2 | $3 | $4 |
| R | TWO PAIR | $2 | $2 | $2 | $2 | $2 |
| S | PAIR JACKS OR BETTER | $1 | $1 | $1 | $1 | $1 |
| T | HIGH CARD/LOW PAIR | $0 | $0 | $0 | $0 | $0 |

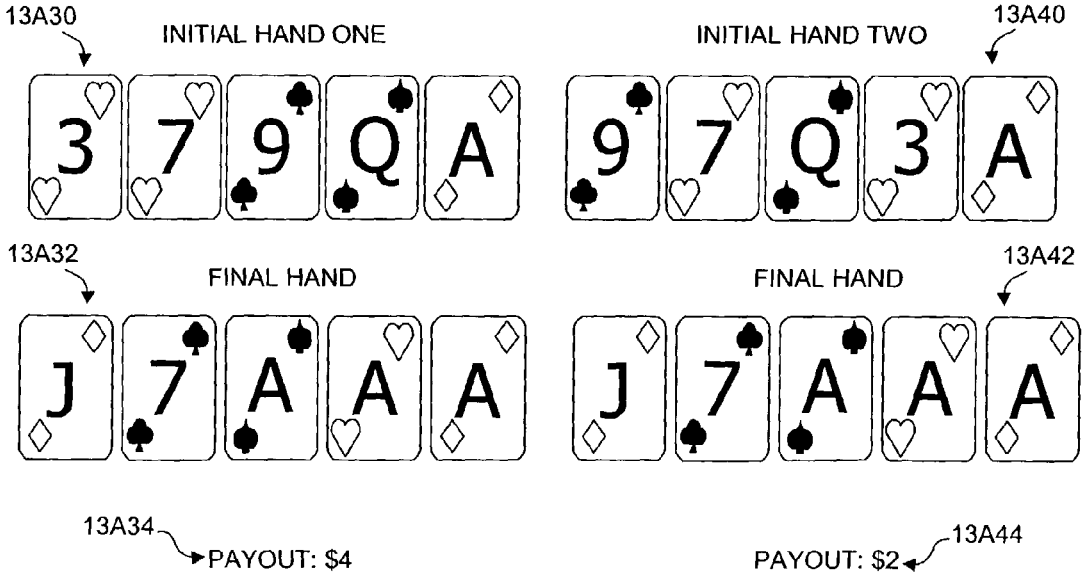

FIG. 13A

ELECTRONIC GAMING DEVICE AND METHOD FOR OPERATING SAME

The present Application is a Continuation-In-Part Application of commonly-owned U.S. patent application Ser. No. 10/034,695, filed Dec. 19, 2001 now U.S. Pat. No. 6,569,014 in the name of Walker et al., entitled "ELECTRONIC POKER DEVICE THAT PROVIDES A PAYOUT BASED ON A NUMBER OF CARDS REPLACED AND METHOD FOR OPERATING SAME"; which is a Continuation Application of commonly-owned U.S. application Ser. No. 09/839,854, filed Apr. 20, 2001 and which issued as U.S. Pat. No. 6,332,839 B2 on Dec. 25, 2001; which is a Continuation Application of commonly-owned U.S. application Ser. No. 09/047,577, filed Mar. 24, 1998 and which issued as U.S. Pat. No. 6,248,016 on Jun. 19, 2001, each of which are incorporated by reference herein for all purposes.

BACKGROUND OF THE INVENTION

The present invention relates to an electronic gaming device, such as a video poker machine, and a method for operating the same.

Slot machines generate over ten billion dollars per year in revenue for United States casinos, with individual machines typically earning between fifty and one hundred fifty dollars per day. One of the fastest growing segments of slot machine play is video poker, a game in which various elements of draw poker are played using a computer with a video display.

The basic game of video poker is played on an electronic video poker machine. A player is dealt an initial hand of five cards from a standard deck of fifty-two cards. The five cards are randomly chosen by the processor of the video poker machine and displayed to the player on a video screen. With a goal of maximizing the value of his hand, the player decides which cards, if any, to hold, and which cards, if any, to discard. Given the initial hand, the player may decide to hold all five of his cards. To do this, he presses a button labeled "hold" under each displayed card.

Alternatively, the player may decide to hold a subset of the five cards dealt to him in his initial hand. In this case, the player presses the "hold" button under each card he decides to hold. After the player has decided which cards to hold, he presses a button labeled "deal." This causes the computer to discard the cards that the player has decided not to hold and replace them with draw cards that have been randomly selected from the remaining forty-seven cards of the deck.

After the deal button has been pressed, the ranking of the final hand of the player is evaluated by the computer. If the player's final hand has a predetermined ranking, such as a FULL HOUSE or THREE OF A KIND, then the player is awarded a payout in the form of either coins or play credits in accordance with a payout table.

The payout table is stored in a memory of the computer and is also displayed on a schedule printed on the machine or on a video screen for the player to view. The payout for a particular final hand generally increases with the ranking of the hand. Thus, hands with higher poker rankings are awarded more play credits or coins. For example, very rare poker hands such as a ROYAL FLUSH are awarded payouts of eight hundred-to-one in some game variations.

FIG. 1 depicts a prior art payout database 10 for a "Jacks or Better" video poker game. Such a database is typically stored in a memory of a conventional video poker machine. The payout database 10 includes records A-J, each of which include fields 15 and 20. For ease of reference, a particular location (intersection of a row and column) within this and other tables herein will be referred to by the concatenated field number and record letter. Such locations will be referred to herein as "cells." For example, cell 15A, containing "ROYAL FLUSH," refers to the location defined by field 15 of record A (the intersection of column 15 and row A).

Cells 15A-15J each indicate a final hand that is possible for a player to receive, given an initial hand of five cards. Cells 20A-20J each indicate a payout (for each $1 wagered) that the associated final hand will pay if it is received. For example, if a player receives a "FULL HOUSE" as a final hand (cell 15D), then the associated payout would be $9 (cell 20D).

A modified video poker machine is described in U.S. Pat. No. 5,401,023 to Wood. According to that patent, a video poker machine is programmed to calculate the expected value of each of the thirty-two possible discard strategies that a player may execute. After a player has selected a discard strategy, the machine adjusts the payouts until the expected value of the executed strategy is nearly equivalent to that of the optimum strategy. In this way, the video poker game is able to provide payouts to players that are not dependent on the skill or experience level of the player.

In addition to the games of video poker described above, other variations which include wild cards and jokers are also played, such as "Joker Poker," "Deuces Wild," and "Bonus Poker." Further information on these and other video poker games, payout tables and calculations, and game strategies may be found in Paymar, D., "Video Poker Precision Play," (published by Enhanceware of Las Vegas, Nev.), which is incorporated herein by reference.

Conventional electronic gaming devices configured to play video poker have a number of disadvantages. Specifically, the number of players who can execute perfect or near-perfect game strategies has increased dramatically. This can be attributed to an increase in the number of tutorial materials that teach such game strategies, which materials have become readily available to players via the Internet, commercial software, and books. Further, competition among casinos to attract video poker players has resulted in video poker machines being programmed to pay out in excess of 100% (assuming perfect playing strategy), which has provided additional incentive for players to learn game strategies from the tutorial materials. The foregoing has increased the aggregate amount of payouts to players and thus decreased profits for the casinos.

Additionally, players initially were attracted to conventional video poker games because of the requirement for the players to use analytical thought and decision making during game play. However, game strategies have not changed much since the introduction of video poker. Indeed, conventional video poker machines do not offer players a chance to execute more complex and non-conventional strategies in order to obtain higher payouts. Consequently, some players have become bored with, and thus lost interest in, conventional video poker games.

In view of the above, there is a substantial need for an electronic gaming device such as a video poker machine, and method for operating the same, that enables casinos to increase revenue and, at the same time, is more interesting for players to play.

BRIEF DESCRIPTION OF THE DRAWINGS

Representative embodiments of the present invention will be described with reference to the following figures.

FIG. 1 depicts a payout table that is used with conventional electronic video poker games.

FIG. 3 depicts a table that is used in determining payouts in accordance with one or more embodiments of the present invention.

FIG. 7A depicts a table that is used in determining payouts in accordance with one or more embodiments of the present invention. FIG. 7A also depicts two games played according to one or more embodiments of the present invention.

FIG. 8A depicts a table that is used in determining payouts in accordance with one or more embodiments of the present invention. FIG. 8A also depicts two games played according to one or more embodiments of the present invention.

FIG. 9A depicts a table that is used in determining payouts in accordance with one or more embodiments of the present invention. FIG. 9A also depicts two games played according to one or more embodiments of the present invention.

FIG. 10A depicts a table that is used in determining payouts in accordance with one or more embodiments of the present invention. FIG. 10A also depicts two games played according to one or more embodiments of the present invention.

FIG. 11A depicts a table that is used in determining payouts in accordance with one or more embodiments of the present invention. FIG. 11A also depicts two games played according to one or more embodiments of the present invention.

FIG. 12A depicts a table that is used in determining payouts in accordance with one or more embodiments of the present invention. FIG. 12A also depicts two games played according to one or more embodiments of the present invention.

FIG. 13A depicts a table that is used in determining payouts in accordance with one or more embodiments of the present invention. FIG. 13A also depicts two games played according to one or more embodiments of the present invention.

DETAILED DESCRIPTION

Figure 2:
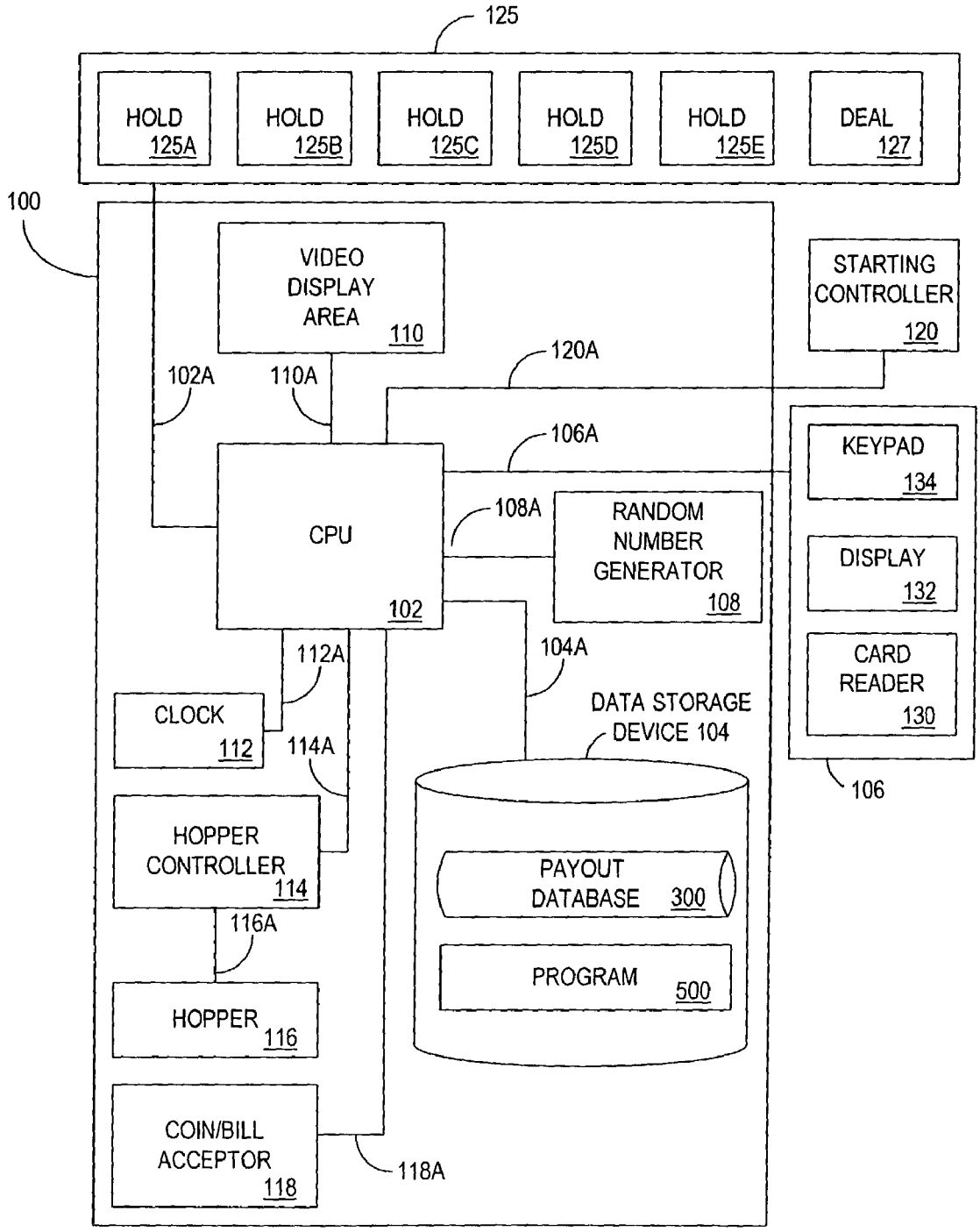
FIG. 2 is a block diagram of a video poker gaming device provided in accordance with one or more embodiments of the present invention.

A first aspect of the present invention is directed to a method for directing a computing device to conduct a game of chance. According to a method consistent with one or more embodiments, the device displays a plurality of game indicia to a player. In one embodiment, the game indicia are cards from a standard deck of playing cards. The device receives a signal representing a selection of game indicia by the player. The game indicia might be selected by the player using, for example, buttons or a touch screen device. The device determines a number of the selected game indicia based on the signal and determines a ranking for the game of chance based on the displayed game indicia. In a preferred embodiment, the game of chance is a video poker game with hand rankings such as "FULL HOUSE" or "STRAIGHT." The device further determines a payout based on the number and ranking.

A second aspect of the present invention is directed to another method for operating a video poker gaming device. In accordance with one or more embodiments, the device displays an initial hand of cards to a player. The device receives a signal representing a selection of discard cards and held cards and determines a number of cards to be drawn based on the signal. The device displays a draw card in place of each discard card such that the held cards and draw cards make up the final hand of the player. The device determines a ranking of the final hand and a payout. The payout is based on the ranking and the number of cards drawn. In another embodiment, the payout may further be based on an amount of money that the player has wagered for the game.

In one or more embodiments, the video poker gaming device determines a payout based on the cards comprising the initial hand, and the cards comprising the final hand. In a first example, a payout may be based both on the ranking of the final hand, and on the cards that are relevant to the ranking of the final hand that were not present in the initial hand. In a second example, a payout may be based on the ranking of the initial hand and based on the ranking of the final hand. In a third example, a payout may be based on the ranking of the final hand and based on a paying card combination from the initial hand that was not present in the final hand. In a fourth example, a payout may be based on the ranking of the final hand and based on the number of cards that were discarded from the initial hand that are relevant to the ranking of the final hand. In a fifth example, a payout may be based on the ranking of the final hand, and the probability with which the player's strategy would have yielded the final hand given the initial hand. In a sixth example, a payout may be based on the ranking of the final hand, and based on the probability with which the player's strategy would have yielded a final hand of the same ranking as the final hand, given the initial hand. In a seventh example, a payout may also be based on the order of cards within the initial hand, within the drawn cards, and/or within the final hand.

It is an advantage of the present invention that a player may execute more complex and non-conventional game strategies as compared to those executed with respect to prior art gaming devices, in order to attempt to obtain a higher payout or to maximize the long term payback of the hand. It is another advantage of the present invention that casinos may experience increased profits because players are unlikely to execute perfect of near perfect game strategies due to the increased game complexity. The above advantages and other objects, features and advantages are readily apparent from the detailed description when taken in connection with the accompanying drawings.

As used herein, unless stated otherwise, the term "ranking" is a noun that refers to the category into which a group of cards falls. Unless stated otherwise, the term "ranking" does not refer to the gerund form of the verb "rank," which means "to place into an order." The present disclosure also uses the noun "rank," which, unless stated otherwise, refers to the number or designation of an individual card. Examples of ranks are "eight," "jack," "queen," "ace," and "two." Ranks may be abbreviated as, e.g. "8," "J" "Q" "A," and "2." The term "rank" should be contrasted with the term "suit" which refers to a separate designation for a card. Exemplary suit designations are "spade," "heart," "diamond," and "club," which may be abbreviated "s," "h," "d," and "c." An abbreviation such as "Kd" may indicate both the rank (king) and suit (diamonds) of a card. One difference between the word "ranking" and "rank" is that the former generally refers to a group of cards, such as a hand of cards, and the latter generally refers to an individual card.

Categories of cards may be understood to form a hierarchy of categories. A first group of cards falling within a first category may therefore be considered to have a higher ranking than a second group of cards falling within a second category, if the first category comes before the second category within the hierarchy. Exemplary category labels, in order of hierarchy, include "ROYAL FLUSH," "STRAIGHT FLUSH," "FOUR OF A KIND," "FULL HOUSE," "FLUSH," "STRAIGHT," "THREE OF A KIND," "TWO PAIR," "PAIR JACKS OR BETTER," and "HIGH CARD/LOW PAIR." The "FOUR OF A KIND" category may, for example, include any group of cards in which four of the cards are of the same rank. Thus, the ranking of the hand 4s 4d 4c 4h Js is "FOUR OF A KIND." The ranking of the hand Qs Qd 9h 9s 3s is "TWO PAIR." The ranking of the hand 4s 4d 4c 4h Js (FOUR OF A KIND) may therefore be said to be higher than the ranking of the hand Qs Qd 9h 9s 3s (TWO PAIR).

Reference is now made to the accompanying Figures for the purpose of describing, in detail, some embodiments of the present invention. The Figures and accompanying detailed description are provided as examples of the invention and are not intended to limit the scope of the claims appended hereto.

In accordance with one or more embodiments of the present invention there is provided an electronic gaming device and method for operating the same, illustrated by way of a video poker gaming device. Referring now to FIG. 2, there is shown a block diagram of a video poker gaming device 100, which includes a central processing unit (CPU) 102 and a data storage device 104 in communication therewith via line 104A. A player card tracking device 106, a random number generator 108, a video display area 110, a clock 112, a hopper controller 114, a coin/bill acceptor 118, and a starting controller 120 are in communication with CPU 102 via lines 106A, 108A, 110A, 112A, 114A, 118A, and 120A, respectively. A hopper 116 is under control of hopper controller 114 via line 116A. A player input panel 125 is in communication with CPU 102 via line 102A.

Video poker gaming device 100 may comprise conventional components, with the exception of payout database 300 and program 500. For purposes of better illustrating the invention, the conventional components, which are well known to those skilled in the art, are described only briefly. Although the described embodiment of the present invention is described as implemented with physical hardware components, the present invention contemplates software embodiments such as would be implemented on the Internet and other computer communication networks.

Still referring to FIG. 2, CPU 102 comprises a well known processing unit, for example, a Pentium® microprocessor manufactured by Intel Corp. of Santa Clara, Calif. Data storage device 104 typically includes one or more machine readable media. Such media include an appropriate combination of semiconductor, magnetic and optical media. In addition to payout database 300 and program 500, data storage device 104 stores appropriate operating system and control software (not shown), each functional to facilitate operation of video poker gaming device 100 as will be understood by those skilled in the art.

Player card tracking device 106 comprises a player tracking interface including a card reader 130 for receiving a player tracking card, a display 132 for communicating alphanumeric messages to a player, and a keypad 134 for receiving player input such as a player identification number/code.

Random number generator 108 comprises a random or pseudo-random number generator suitable for use in a gaming device. Clock 112 comprises a clock for providing timing signals to CPU 102. Hopper controller 114, and hopper 116 connected thereto, are operative under the control of CPU 102 to dispense and provide coins to a player. Coin/Bill acceptor 118 is operative to receive one or more coins or bills, and to transmit an appropriate value signal to CPU 102 indicating the monetary amount wagered.

Player input panel 125 includes a plurality of buttons 125A-125E and 127. In the video poker gaming device of the present embodiment, buttons 125A-125E each are labeled "hold." Using buttons 125A-125E a player may select which cards from an initial hand of cards he desires to hold, if any. Accordingly, cards which a player does not desire to hold are to be discarded. Button 127 is labeled "deal" and is used to indicate when a player has completed selecting which cards to hold. A signal indicating which cards have been selected by a player is transmitted from player input panel 125 to CPU 102 via line 102A.

In an alternate embodiment, buttons 125A-125E are used to select the cards that the player wants to discard, with the signal similarly transmitted to CPU 102 via line 102A. Video display 110 preferably comprises a conventional video display device, for example, a cathode ray tube or a liquid crystal display screen. Alternatively, video display 110 may comprise a touch sensitive screen capable of processing player selections through tactile input. Of course, in this alternative embodiment, buttons 125A-125E and 127 are not required because they can be implemented using the touch sensitive screen. Starting controller 120 comprises a player-operated device such as a handle or button for initiating play of a game.

Gaming device 100 may include a conventional network interface (not shown) for communicating with a central network server thus allowing for the remote monitoring and auditing of gaming device 100.

Referring next to FIG. 3, payout database 300 is represented by a payout table that associates each of a plurality of final hands (e.g., a "FULL HOUSE") with a particular payout. The payouts stored in payout database 300 are provided for each $1 wagered. Unlike the prior art, in which the association of a payout and a final hand is based only on the number of coins that a player wagers and the ranking of the final hand, in embodiments of the present invention a particular payout is determined based on an additional factor (e.g., the number of cards that a player draws to obtain the final hand). Determining the payout in this manner allows players to execute more complex and non-conventional game strategies in order to obtain higher payouts, as compared to those executed when playing conventional video poker games. This will increase player interest in the inventive video poker gaming device and method. Also, because more complex game strategies are involved, the players are not easily able to execute perfect or near-perfect game strategies.

The rows and columns of the payout database 300 represent records and fields thereof, respectively. It is noted that while the following description refers to specific individual databases, formats, records, and fields, those skilled in the art will readily appreciate that various modifications and substitutions may be made thereto without departing from the spirit and scope of the present invention.

For exemplary purposes, payout database 300 is shown to include seven fields 310-316. Field 310 stores data indicating a ranking of a final hand that a player may obtain, given an initial hand of five cards. Thus, in this embodiment, it is possible for a player to obtain a "ROYAL FLUSH, "STRAIGHT FLUSH," "FOUR OF A KIND," "FULL HOUSE," "FLUSH," "STRAIGHT," "THREE OF A KIND," "TWO PAIR," "PAIR OF JACKS OR BETTER," or "HIGH CARD/LOW PAIR." Of course, other final hands, such as those incorporating jokers, wild cards, or specific card bonuses are deemed to be within the scope of the present invention.

Fields 311-316 store data indicating a payout for a final hand, which payout is based on the ranking of the final hand and on the number of cards that a player draws to obtain the final hand. Thus, field 311 indicates a payout for a final hand in which a player has not drawn any cards—i.e., the player stands with the initial hand. Similarly, fields 312-316 indicate a payout for a final hand in which a player has drawn one, two, three, four, or five cards, respectively, to obtain the final hand. The payout may be adjusted to reflect the number of coins wagered by the player, with bonuses provided for maximum coin wagers as is well known in the art.

For example, record M stores data for a payout in which the final hand is "FOUR OF A KIND" (cell 310M). In this case, if a player has been dealt FOUR OF A KIND and chooses not to draw any cards, the payout would be $50 (cell 311M). Similarly, if a player has been dealt an initial hand and draws one, two, three, four, or five cards to obtain FOUR OF A KIND, the payout would be $20, $25, $25, $30, and $40 (cells 312M-316M), respectively.

To illustrate further, consider a player who is dealt an initial hand comprising the Nine of hearts (9h), Nine of diamonds (9d), Two of spades (2s), Six of hearts (6h), and Jack of hearts (Jh). In a conventional Jacks or Better video poker gaming device, a player would (and should) normally elect to hold the pair of nines (9h-9d) and draw three cards. This strategy may be employed in an attempt to obtain a hand such as THREE OF A KIND or FOUR OF A KIND for a payout of $3 or $25, respectively, as illustrated by cells 20G and 20C of FIG. 1. A player would not usually draw two cards in an attempt to obtain a FLUSH because such a play results in a lower expected value. This is because the average return or expected value of holding the pair (9h 9d) is significantly greater than the average return of holding the three hearts (9h 6h Jh). While the average return of holding the pair is $0.82 for each dollar coin wagered, holding the three hearts results in an average return of $0.43 for each dollar coin wagered. The player is thus giving up almost forty cents per dollar coin wagered every time that he draws to the three hearts.

In the video poker gaming device of the present invention, however, a player is encouraged to draw two cards in an attempt to obtain a FLUSH because he is tempted by the $7 payout (see cell 313O). The possibility of obtaining this higher payout, as compared to a $6 payout for a FLUSH in a conventional video poker machine, will serve to increase player interest in the game because the player is given an opportunity to execute more complex and non-conventional game strategies in order to obtain a higher payout, as compared to prior art electronic gaming devices. Players who elect to hold the three hearts in the hopes of attaining the $7 payout, however, are technically still making a poor wagering decision, although not as poor as with conventional payout tables.

While the expected value of holding the three hearts has increased from $0.43 to $0.47, the expected value of holding the pair of nines remains at $0.82 and is thus the superior decision. As one of ordinary skill in the art can appreciate, by increasing the payout for two card draws to FLUSHES, players may be allowed to enjoy a wider range of plays they may find acceptable. By changing the payout table, plays that were once too speculative (e.g. three card STRAIGHT FLUSH draws) may now fall within an acceptable range of average return for those players looking for the excitement of larger, less frequent payouts. By convincing a player to make a lower expected value play, the casino's advantage is increased.

The profitability derived from the inventive video poker gaming device is directly related to the values stored in payout fields 311-316, although player skill levels will also have an impact on profitability. In addition to basing a payout on the number of cards drawn to obtain a final hand, the payout values may be set so that perfect play results in a small advantage for the casino and average play results in a reasonable payout to a player. Thus, in described embodiments, the payout is set to generally increase as the number of cards drawn increases from one to five. For example, record K stores data for a final hand that is a ROYAL FLUSH (cell 310K). In this case, it is seen that the payout for obtaining the ROYAL FLUSH is $500, $600, $1000, $2000, and $5000 for drawing one, two, three, four, and five cards, respectively (cells 312K-316K). Similarly, record Q stores data for a final hand that is a THREE OF A KIND (cell 310Q). It is seen that the payout for obtaining this final hand generally increases as the number of draw cards increases, paying $3, $3, $4, $5, and $7 for drawing one, two, three, four, and five cards (cells 312Q-316Q), respectively. Of course, the foregoing payouts have been described for exemplary purposes. Accordingly, the payout values stored in the fields 311-316 may be set as desired.

Figure 4:
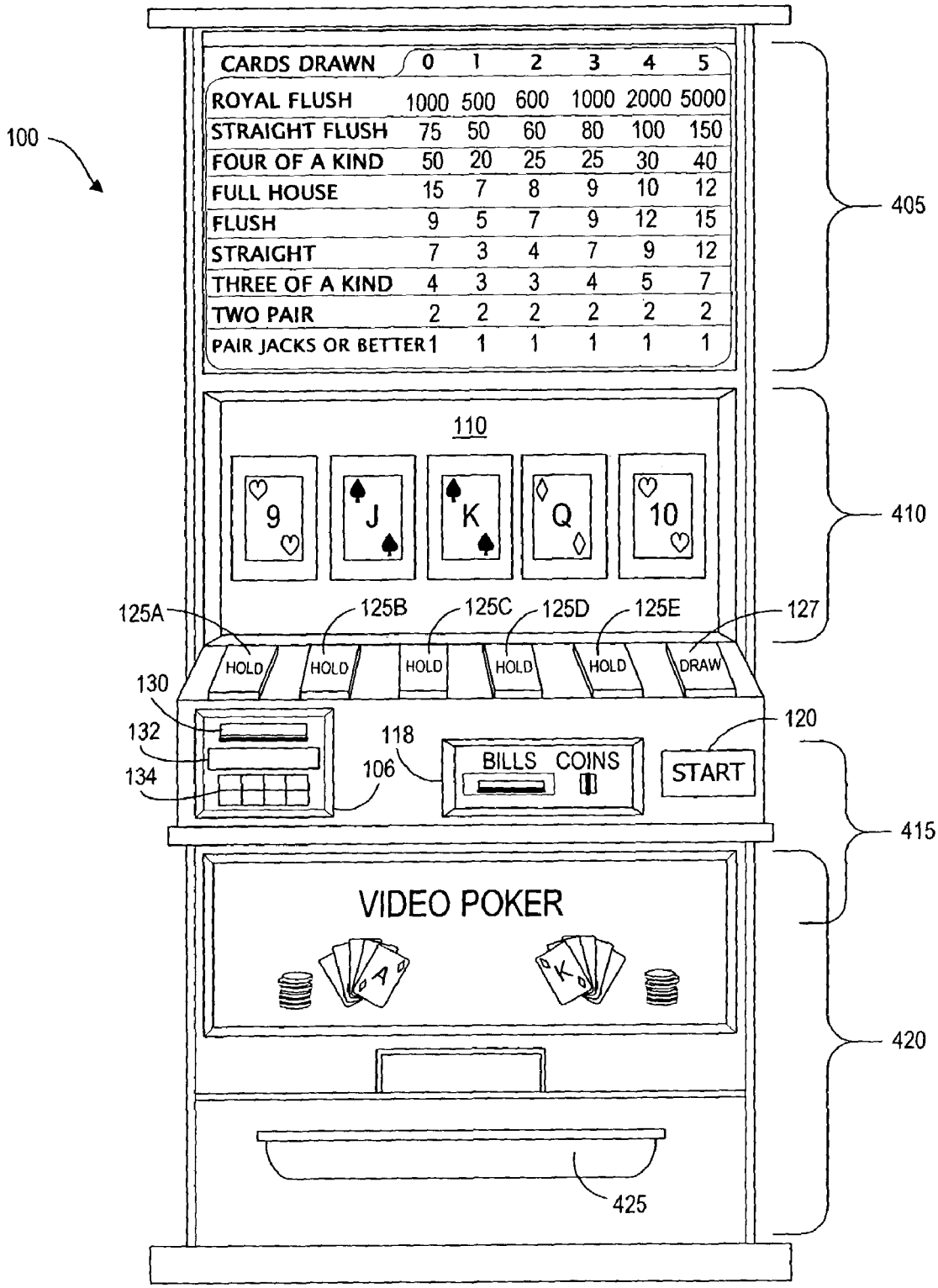
FIG. 4 is a plan view of a video poker gaming device provided in accordance with one or more embodiments of the present invention.

Referring now to FIG. 4, a plan view is shown of gaming device 100 of the present invention which, for purposes of discussion, is generally divided into four sections: an upper panel 405, a display panel 410, an interface panel 415, and a lower panel 420.

Upper panel 405 includes a diagram depicting a payout table for the gaming device. The values should correspond to the payouts stored in payout database 300 and may be printed on glass with a back lighting scheme for maximum player visibility.

Display panel 410 contains video display area 110, which displays a player's cards. Interface panel 415 includes starting controller 120, player tracking device 106 (including card reader 130, display 132, and keypad 134), and coin/bill acceptor 118. Lower panel 420 includes promotional messages which may serve to attract players to the game or to provide rules/instructions concerning operation of the game, and a coin tray 425.

Figure 5:
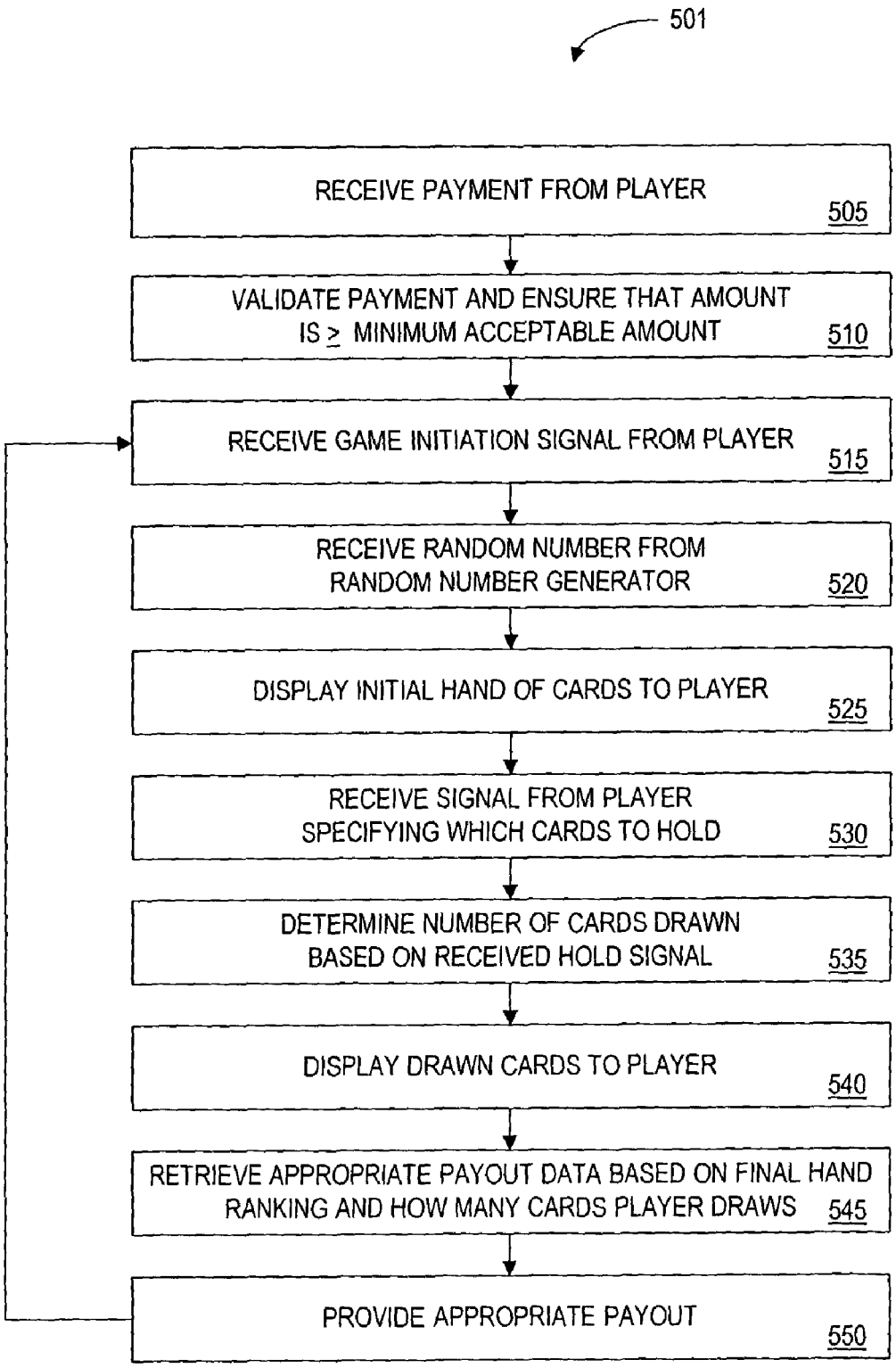
FIG. 5 is a flowchart illustrating a method for operating a video poker gaming device in accordance with one or more embodiments of the present invention.

Referring again to FIG. 2, data storage device 104 also includes program 500. Program 500 comprises computer instructions and/or data, executable or otherwise, for executing the functionality of the present invention. FIG. 5 depicts game play process 501 that may be embodied by such a program 500 for operating a video poker gaming device in accordance with one or more embodiments.

At step 505, the video poker gaming device 100 receives payment from a player. In the described embodiment, the player inserts bills or coins into bill/coin acceptor 118. The appropriate signals are communicated to CPU 102 via line 118A to indicate a monetary amount that is being wagered.

At step 510, CPU 102 validates the payment received at step 505 and ensures that the payment received is greater than or equal to a minimum acceptable amount.

At step 515, the video poker gaming device 100 receives a game initiation signal from a player. Thus, when a player activates starting controller 120, such as by depressing a button labeled "START" or pulling a lever (not shown), an appropriate game initiation signal is communicated to CPU 102 via line 120A.

Processing continues at step 520 where CPU 102 receives a random number from random number generator 108 via line 108A. As is well known, the random number acts as a seed from which a player will be dealt an initial hand of cards, and any subsequent draw cards, from a standard deck of fifty-two playing cards.

At step 525, CPU 102 displays an initial hand of cards to a player. In this embodiment, CPU 102 generates a plurality of cards (e.g., ten) using the random number received at step 520. The initial hand, in the form of certain of the plurality of cards, is displayed to a player via video display area 110.

At step 530, CPU 102 receives a signal indicating which cards have been selected by a player. In this video poker embodiment, the selected cards indicate those which a player has decided to hold and therefore also indicates those which the player has discarded. A player may select the cards by depressing one or more of the hold buttons 125A-125E. A signal indicating which cards a player has decided to hold is communicated to CPU 102 via line 102A after deal button 127 is depressed.

At step 535, CPU 102 determines the number of cards that a player has decided to draw. This is done by subtracting the number of cards that a player has decided to hold, as indicated by the signal received at step 530, from the number of cards in the initial hand of cards.

For each card that a player has decided to discard, CPU 102 displays on video display area 110 an additional draw card in place thereof at step 540. The draw cards are chosen by CPU 102 from the remaining five cards that were selected at step 525. The cards that a player has decided to hold from the initial hand dealt at step 525 and the additional draw cards make up the final hand of the player for which a ranking and payout will be determined.

At step 545, CPU 102 determines a payout to a player based on the number of cards that a player has decided to draw, as determined at step 535. In this embodiment, CPU 102 determines the ranking of the final hand (i.e., which of the final hands 310K-310T a player has obtained), and accesses the record in payout database 300 that corresponds to that ranking. CPU 102 reads the payout value from the field 310-316 of the accessed record that corresponds to the number of cards that a player has drawn. The payout value may of course be adjusted to reflect the number of coins wagered by the player.

At step 550, CPU 102 causes the payout determined at step 545 to be provided to the player. In this embodiment, hopper 116 dispenses a coin payout (or play credits) to the player under the control of hopper controller 114, which is under control of CPU 102. Processing then may return to step 515 so that a player may play another game.

Figure 6:
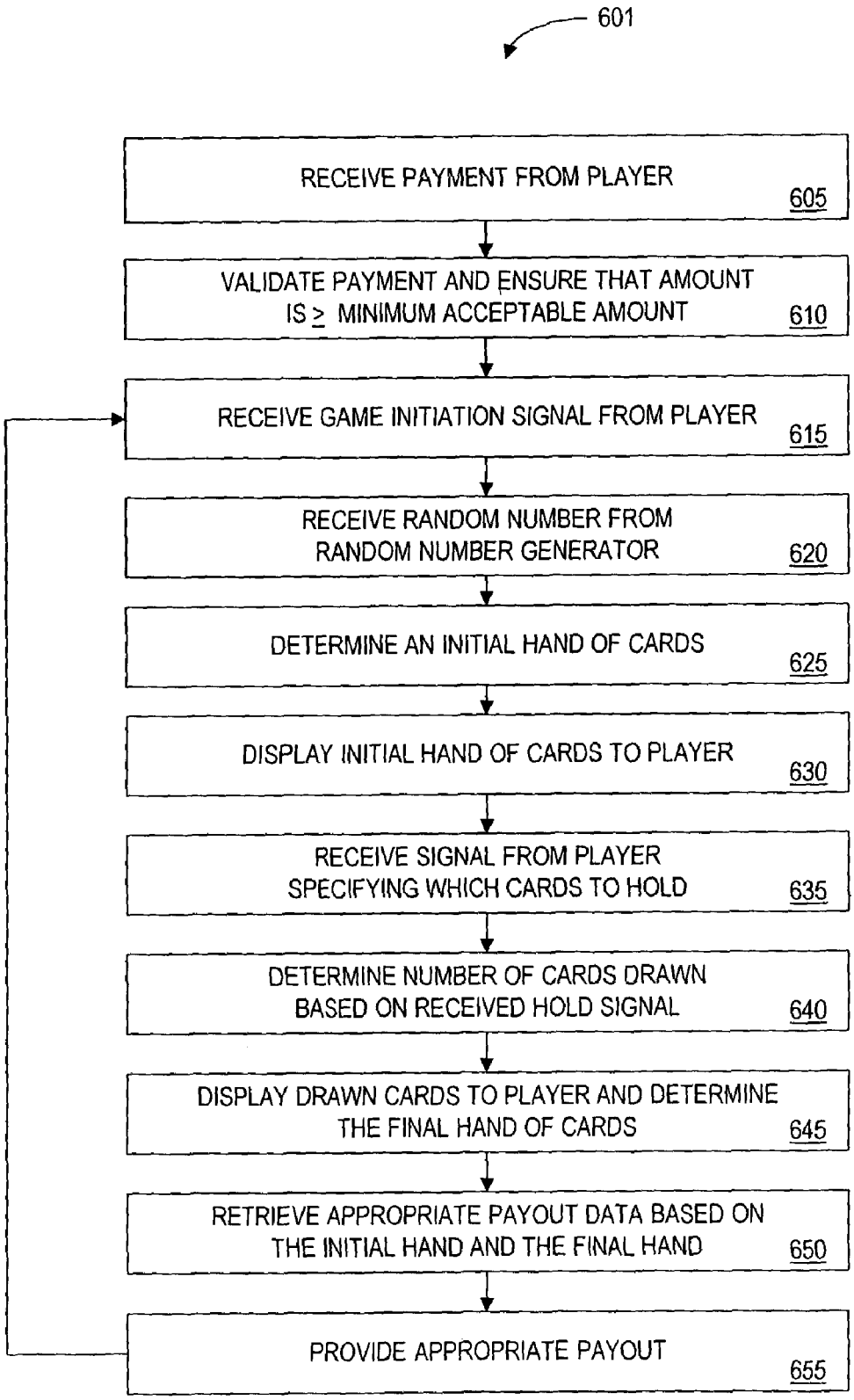
FIG. 6 is a flow chart illustrating a method for operating a video poker gaming device in accordance with one or more embodiments of the present invention.

FIG. 6 depicts another game play process 601 that may be embodied by program 500 for operating a video poker gaming device in accordance with one or more embodiments of the invention. Game play process 601 parallels process 501 through steps 605, 610, 615, and 620. Steps 605 through 620 involve receiving a payment from a player, validating the payment and ensuring that the payment is greater than or equal to a minimum acceptable amount required for play, receiving a game initiation signal from the player and obtaining a random number from the random number generator.

Then, at step 625, the CPU 102 determines an initial hand of cards. As before, the CPU 102 may determine the hand of cards (both dealt and drawn) by using the random number as a seed for ordering a deck of cards and by dealing the hand of cards from the top of the deck, as is well known in the art. At step 630, the CPU 102 causes video display area 110 to display the initial hand of cards. At step 635, the player selects a combination of cards from his initial hand to hold. Equivalently, the player may specify a combination of cards to discard. The combination of cards may include anywhere from zero to the number of cards in the hand. The player may indicate his selection by actuating hold buttons 125A-E, and by then pressing deal button 127. A hold signal indicating the player's selections may thereby be transmitted to the CPU 102.

At step 640, the CPU 102 may determine based on the hold signal the number of cards to be drawn. The CPU 102 may then determine the drawn cards by, for example, retrieving cards from the top of the electronic deck previously ordered using the random number received at step 620. At step 645, the CPU 102 may cause display area 110 to display the drawn cards in place of the cards discarded from the initial hand. The displayed hand, including the cards held from the original hand, and the drawn cards, now constitutes the final hand.

At step 650, the CPU 102 may determine payout data based on the initial hand, determined at step 625, and the final hand, determined at step 645. Various methods by which the CPU 102 may determine the payout based on the initial hand and the final hand are described further below by reference to FIGS. 7-13A. At step 655, the CPU 102 may direct the hopper controller 114 to cause the hopper 116 to dispense coins or tokens in the amount of the payout. In some embodiments, a payout is instead provided in terms of electronic credits.

Figure 7:
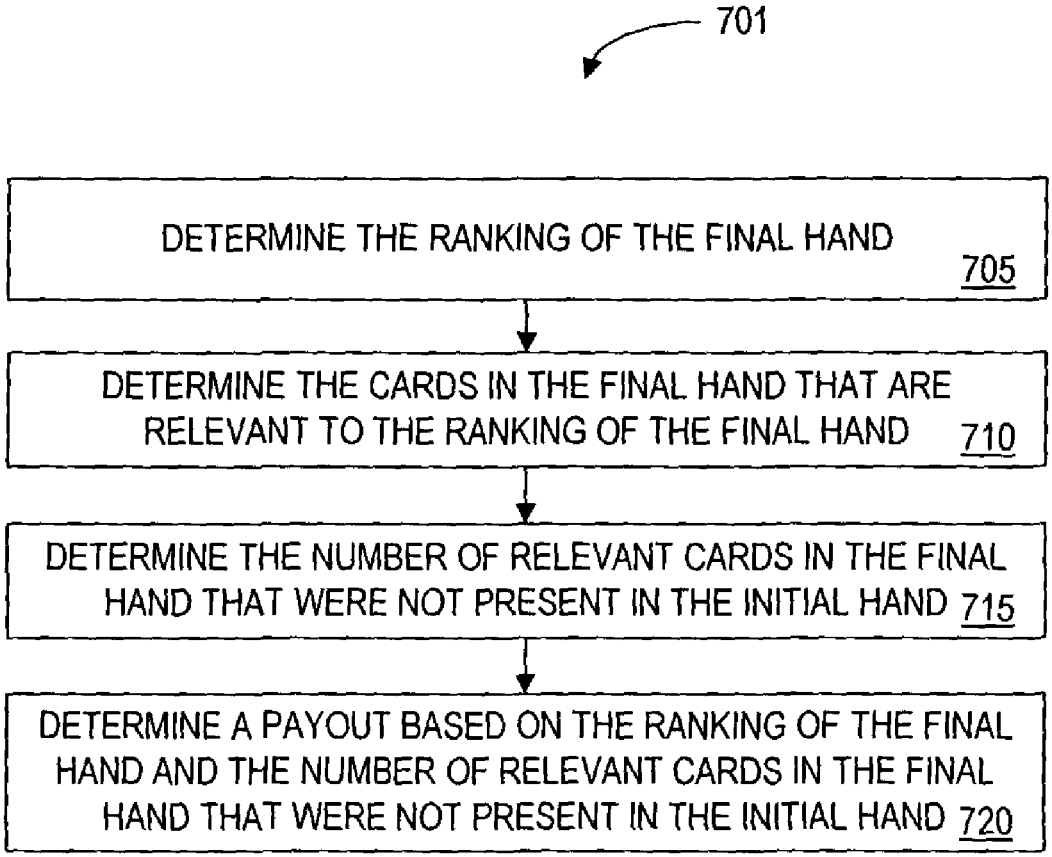
FIG. 7 is a flow chart illustrating a method for operating a video poker gaming device in accordance with one or more embodiments of the present invention.

Referring now to FIG. 7, an exemplary process 701 is described for determining a payout based on the initial hand and the final hand described in process 601 in accordance with one or more embodiments. Process 701 may be performed, for example, by CPU 102. At step 705, CPU 102 determines the ranking of the final hand. At step 710, CPU 102 determines the cards in the final hand that are relevant to the ranking of the final hand.

As used herein, the term "relevant" denotes a card or set of cards that contribute, or could contribute, to giving a final hand of cards its ranking. A relevant card, if removed from a final hand without being replaced by a suitable substitute (e.g., a card of the same rank as the relevant card if the relevant card contributes to a pair, or a card of the same suit as the relevant card if the relevant card contributes to a FLUSH), would leave the final hand with a lower ranking than it had initially. In contrast, if an irrelevant card is removed from a final hand and a new card takes its place, than the final hand cannot have a lower ranking than it had originally. In addition, a relevant card may be a card that is not in a final hand, but which would contribute to the ranking of the final hand if placed into the final hand, e.g., as a substitute for a card currently within the final hand.

It should be further noted that the relevance of a particular card may be determined at various different times within a game. A card that is determined to be not relevant at a first point in time may later be determined relavent based on the composition of the final hand. For example, suppose an initial hand is Js Jh 8c 6d 3s. The player chooses to hold the Js Jh. Now, even before the final hand is dealt, it may be determined that the Js, Jh, Jd, and Jc are all relevant to the final hand, since the final hand will contain at least a pair of jacks, and additional jacks would only increase the ranking of the final hand. However, before the final hand is dealt, the 8c may not be considered relevant. Suppose then that the replacement cards of 8h 8s 4s are dealt, yielding a final hand of Js Jh 8h 8s 4s. The 8c may now be determined to be relevant to the ranking of the final hand, since the final hand contains two eights, and the 8c, if substituted in for one of the cards currently in the final hand, would increase the ranking of the final hand.

It should also be appreciated, that although the present disclosure makes reference to cards that are relevant to a final hand, cards may just as well be relevant to an initial hand. For example, where an initial hand contains a pair of queens, then all queens may be relevant to the initial hand. Cards may also be said to be relevant to the "current" hand, where the current hand is either an initial hand or a final hand, whichever is currently displayed on the screen of a gaming device. A card may thus be relevant at a first stage in a game (e.g., relevant to the initial hand), but may become irrelevant at a later stage in the game (e.g., the card is not relevant to the final hand).

Following are several examples that illustrate the relevance to a final hand of a card or group of cards. In a first example, suppose a final hand of cards is: Ks Kd 4h 3h 8c. The ranking of this final hand is PAIR JACKS OR BETTER, since the hand contains a pair of kings, and kings are "better" (i.e., higher in the card hierarchy) than jacks. Thus, it is the two kings that contribute to this final hand's ranking, and so the two kings, the Ks and the Kd, are the cards that are relevant to this final hand. Removing the Kd, and replacing it with another card (other than another king), would result in a final hand that no longer has the ranking of a PAIR JACKS OR BETTER. (Incidentally, the removing of the Kd is only being posed as a hypothetical illustration of relevance. No actual game is being played.) The same would occur by removing the Ks. In this example, the 4h, 3h, and 8c are not relevant, since removal and replacement of any of them would not reduce the ranking of the final hand (although the ranking may increase e.g., with a third king).

In another example, suppose a final hand of cards is Ah 9h Jh 8h 2h. The ranking of the final hand is a FLUSH, since all cards are hearts. In this example, every card in the hand is relevant, since each contributes to the ranking of a FLUSH. Replacement of any of the cards, e.g., with a non-heart, may lead to a final hand which is no longer a FLUSH. In a third example, suppose a final hand is 8s 8h 2c 2h Jd. In this final hand, the 8s, 8h, 2c, and 2h are relevant, since all contribute to the final hand's ranking of TWO PAIR. However, the Jd is not relevant. Furthermore, the card 8d (not present in the final hand) would be relevant since, if it were substituted into the final hand 8s 8h 2c 2h Jd, it would contribute to the ranking of the final hand. For example, 8s 8h 2c 2h 8d is a FULL HOUSE, or 8s 8h 8d 2h Jd is THREE OF A KIND.

In one or more embodiments, a position within a hand of cards may be considered relevant rather than, or in addition to an actual card being considered relevant. For example, in the final hand 9s 3c Qs Qd 7s, the 9s occupies the first position, the 3c occupies the second positions, and so on. In this final hand, the third and fourth positions may be said to be relevant, since the third and fourth positions contain relevant cards. Thus, in one or more embodiments, a payout may be based in part on whether a certain position that is relevant in a final hand is occupied by the same card that occupied the same position in the initial hand. For example, for a game in which the third card position is relevant in the final hand, and in which the third card position in the final hand is occupied by the 8d, the payout may be based on whether the third card position in the corresponding initial hand also contains the 8d.

Once CPU 102 has determined at step 715 the cards in the final hand that are relevant to the final hand, the CPU 102 may proceed to step 715 where it may determine the number of cards in the final hand that were not present in the initial hand. To perform this step, the CPU 102 may consider, in turn, each of the relevant cards in the final hand, and check a stored representation of the initial hand to determine whether each of the relevant cards in the final hand was present in the initial hand. Once the CPU 102 has determined the number of relevant cards from the final hand that were present in the initial hand, the CPU 102 may determine at step 720 a payout based on this number and based on the ranking of the final hand.

The payout determined at step 720 may be determined in a number of ways. In one embodiment, the payout is determined by reference to a database such as 7A00 depicted in FIG. 7A. Each record K-T of 7A00 represents a particular final hand ranking, such as "ROYAL FLUSH" for record K, or "STRAIGHT FLUSH" for record L. Each record includes six fields, fields 7A14, 7A16, 7A18, 7A20, 7A22, and 7A24. Each field stores a payout corresponding to a particular number of cards present in the final hand, and not present in the initial hand, that are relevant to the ranking of the final hand. For example, field 7A16 of record K stores a payout of $900 for a final hand of the ranking "ROYAL FLUSH" where only one card relevant to the final hand was not present in the initial hand.

FIG. 7A also illustrates two exemplary games of video poker. The first game begins with Initial Hand One 7A30 and ends with Final Hand 7A32. The second game begins with Initial Hand Two 7A40 and ends with Final Hand 7A42. As it happens, the Final Hands are identical, with each containing three sevens for a ranking of "THREE OF A KIND." However, for the first game the payout is $4 7A34, and for the second game the payout is $3 7A44. Examination of the two initial hands reveals why the payout is different. Initial Hand One 7A30 contains only one seven, and therefore the Final Hand in the first game 7A32 contains two new sevens, i.e., two relevant cards that were not present in Initial Hand One 7A30. Initial Hand Two 7A40, on the other hand, contains two sevens. Therefore, the Final Hand for the second game 7A42 contains only one new seven, i.e., only one relevant card that was not present in Initial Hand Two 7A40. The payout for the first exemplary game can be found under field 7A18 of record Q of table 7A00. The payout is $4. The payout for the second exemplary game can be found under field 7A16 of record Q of table 7A00. The payout is $3.

Table 7A00 contains several records with "N/A" listed in one or more fields. For example, record Q has "N/A" listed under field 7A22. "N/A" is used as an abbreviation for "not applicable." A particular field may not be applicable to a particular record if there are fewer than five cards that are relevant to the hand ranking corresponding to the record. For example, a hand with a ranking of "THREE OF A KIND" has only three relevant cards. Thus, there cannot be four relevant cards in a final hand of "THREE OF A KIND" that were not present in the initial hand.

It should be understood that table 7A00 contains payout data that is only exemplary, and many other payouts are possible for each field of each record. No representation is made that table 7A00 is the best table in any sense, nor that such a table would even be profitable for the casino. In other versions of poker, a table such as 7A00 might include additional records corresponding to additional final hand rankings, such as "FIVE OF A KIND" or "FOUR ACES." Furthermore, a table such as 7A00 might contain fewer fields if, for example, the table corresponds to a version of poker where fewer than five cards can be drawn. Similarly, a table such as 7A00 may contain a greater number of fields for versions of poker where hands consist of more than five cards.

As depicted, table 7A00 illustrates a general trend of increasing payouts for a given final hand ranking as a greater number of cards relevant to the final hand were not present in the corresponding initial hand. For example, examining record O, corresponding to a final hand ranking of "FLUSH," the payout is $3 when there are zero cards relevant to the ranking of the final hand that were not present in the initial hand, and the payout is $9 when there are five cards relevant to the final hand that were not present in the initial hand. In the first case, a player would have made a FLUSH without having to draw any new cards to his initial hand. In the second case, a player would have had to draw five cards to his initial hand in order to make the FLUSH. Thus, one rationale for providing a higher payout in the second case is that achieving the final hand was more difficult given the initial hand—five of the right cards had to be drawn in order to make the FLUSH versus no cards having to be drawn in the first case. With the payout table 7A00 in place, a player might be encouraged to pursue strategies whose success depends on drawing multiple new cards in order to achieve a desired final hand ranking. By drawing multiple new cards in order to achieve the final hand ranking, the player is assured that, if he achieves his desired hand, the desired hand will have multiple relevant cards that were not present in the initial hand.

For example, suppose a player's initial hand is 10h 10d 9h 8h Ad. The player might consider several strategies. One strategy would hold the 10h and 10d, and discard the remaining three cards. With this strategy, the player could achieve TWO PAIR, THREE OF A KIND, a FULL HOUSE, or FOUR OF A KIND. Another strategy would hold the 10h 9h 8h, with possibilities of achieving a STRAIGHT FLUSH, STRAIGHT, or FLUSH, among other things. A third strategy would hold the Ad 10d, with the possibility of achieving a ROYAL FLUSH. Ordinarily, the player might be inclined to hold the 10h and 10d. However, with this strategy, winning final hands would likely have rankings of THREE OF A KIND, or TWO PAIR. With these final hands, the player would only have obtained one or two relevant cards that were not already present in the initial hand. Even if the player held the 10h 9h 8h, he would only obtain two new relevant cards in making a STRAIGHT, FLUSH, STRAIGHT FLUSH, TWO PAIR, or THREE OF A KIND. By employing the third strategy of holding the Ad 10d, the player can not only hope for a ROYAL FLUSH, but also one where he has drawn three additional relevant cards to achieve the ROYAL FLUSH. The player can therefore expect to get a relatively large payout for achieving the ROYAL FLUSH. According to the table of 7A00, the player would win $2500 for achieving a ROYAL FLUSH after drawing the three relevant cards of Jd Qd Kd, none of which were present in the initial hand.

It can thus be seen that the present embodiment may increase the complexity of play by allowing a player to consider not only what final hands he would like to achieve, but also the number of additional relevant cards he would need in order to achieve the final hands. Furthermore, this embodiment allows for the occurrence of certain events that are far more unlikely than any event that may occur in a typical game of video poker. For example, it is far more unlikely to achieve a ROYAL FLUSH where none of the five relevant cards in the final hand were present in the initial hand, than it is to simply achieve a final hand with a ROYAL FLUSH. Therefore, higher payouts can be awarded to correspond with the more unlikely events.

Figure 8:
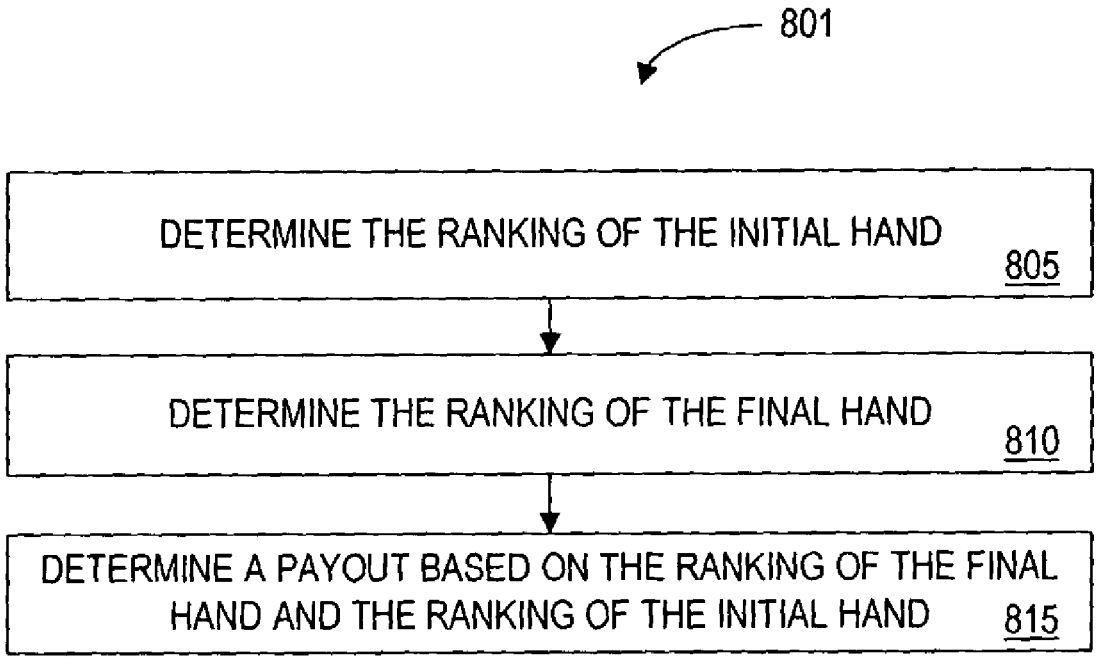
FIG. 8 is a flow chart illustrating a method for operating a video poker gaming device in accordance with one or more embodiments of the present invention.

Referring now to FIG. 8, a process 801 is described for determining a payout based on the initial hand and the final hand described in process 601 in accordance with one or more embodiments. Process 801 may be performed, for example, by CPU 102. At step 805, CPU 102 determines the ranking of the initial hand. At step 810, CPU 102 determines the ranking of the final hand. At step 815, CPU 102 determines a payout based on the ranking of the final hand and the ranking of the initial hand.

The payout determined at step 815 may be determined in a number of ways. In one embodiment, the payout is determined by reference to a database such as 8A00 depicted in FIG. 8A. Each record K-T of 8A00 represents a particular final hand ranking, such as "ROYAL FLUSH" for record K, or "STRAIGHT FLUSH" for record L. Each record includes ten fields, of which four fields, fields 8A14, 8A16, 8A18, and 8A20, are shown. Each field represents an initial hand ranking. Possible initial hand rankings are similar to possible final hand rankings, and include "HIGH CARD/LOW PAIR" 8A14 all the way up through "ROYAL FLUSH" 8A20. Each field of each record stores a payout for a hand which has the corresponding initial hand ranking and the corresponding final hand ranking. For example, field 8A16 of record O stores a payout of $7 for a hand in which the final hand ranking is "FLUSH" and where the initial hand ranking is "PAIR JACKS OR BETTER." Field 8A16 of record O may correspond to a hand, for example, in which a player was initially dealt Ks Kh Jh 8h 2h, discarded the Ks, was dealt a replacement card of 7h, and finished with a final hand therefore of 7h Kh Jh 8h 2h.

FIG. 8A also illustrates two exemplary games of video poker. The first game begins with Initial Hand One 8A30 and ends with Final Hand 8A32. The second game begins with Initial Hand Two 8A40 and ends with Final Hand 8A42. The Final Hands are identical, with each containing Ks Qs Js 10s 9s for a ranking of "STRAIGHT FLUSH." However, for the first game the payout is $50 8A34, and for the second game the payout is $55 8A44. Examination of the two initial hands reveals why the payout is different. Initial Hand One 8A30, consisting of Qh Qs Js 10s 9s, contains a pair of queens, and therefore has a ranking of "PAIR JACKS OR BETTER." Initial Hand Two 8A40, consisting of 2h Qs Js 10s 9s, has a ranking of "HIGH CARD/LOW PAIR." Therefore, the payout for the first game can be found under field 8A16 of record K (a $50 payout), and the payout for the second game can be found under field 8A14 of record K (a $55 payout).

Table 8A00 contains several records with "N/A" listed in field 8A20. Such a table may reflect a game in which a player would not be allowed to discard any cards from an initial hand if his starting hand had a ranking of "ROYAL FLUSH," as improvement of the hand is not possible.

It should be understood that table 8A00 contains payout data that is only exemplary, and many other payouts are possible for each field of each record. No representation is made that table 8A00 is the best table in any sense, nor that such a table would even be profitable for the casino. In other versions of poker, a table such as 8A00 might include additional records corresponding to additional final hand rankings, such as "FIVE OF A KIND" or "FOUR ACES." Similarly, table 8A00 might include additional fields corresponding to additional initial hand rankings. Furthermore, a table such as 8A00 might contain fewer records and fields if, for example, the table corresponds to a version of poker where fewer than the illustrated number of possible hand rankings are possible.

As depicted, table 8A00 illustrates a general trend of decreasing payouts for a given final hand ranking as the ranking of the corresponding initial hand increases. For example, suppose a player has a final hand with a ranking of "FLUSH." The player is better off having begun with a hand ranked "HIGH CARD/LOW PAIR" than with a hand ranked "PAIR JACKS OR BETTER" or "STRAIGHT FLUSH." In many cases, this trend of decreasing payouts reflects a greater difficulty of achieving a final hand of a given ranking when starting from a relatively lower ranked initial hand than when starting from a relatively higher ranked initial hand. For example, it is more difficult to achieve FOUR OF A KIND after having started with a hand ranked "PAIR JACKS OR BETTER," than after having started with a hand ranked "THREE OF A KIND." Of course, in some cases, it is no more difficult to achieve a final hand of a given ranking when starting from a first initial hand of a relatively lower ranking than when starting from a second initial hand of a relatively higher ranking. However, the decreasing trend of payouts may still be in keeping with player psychology. A player may believe he should achieve a relatively greater reward when he has made a larger "jump" in ranking than when he has made a relatively smaller "jump" in ranking. Furthermore, a table such as that in 8A00 may contain other payouts than are illustrated, and may even depict opposite trends to those shown in table 8A00. For example, payouts may actually increase for a given final hand as the rankings for corresponding initial hands increase.

Figure 9:
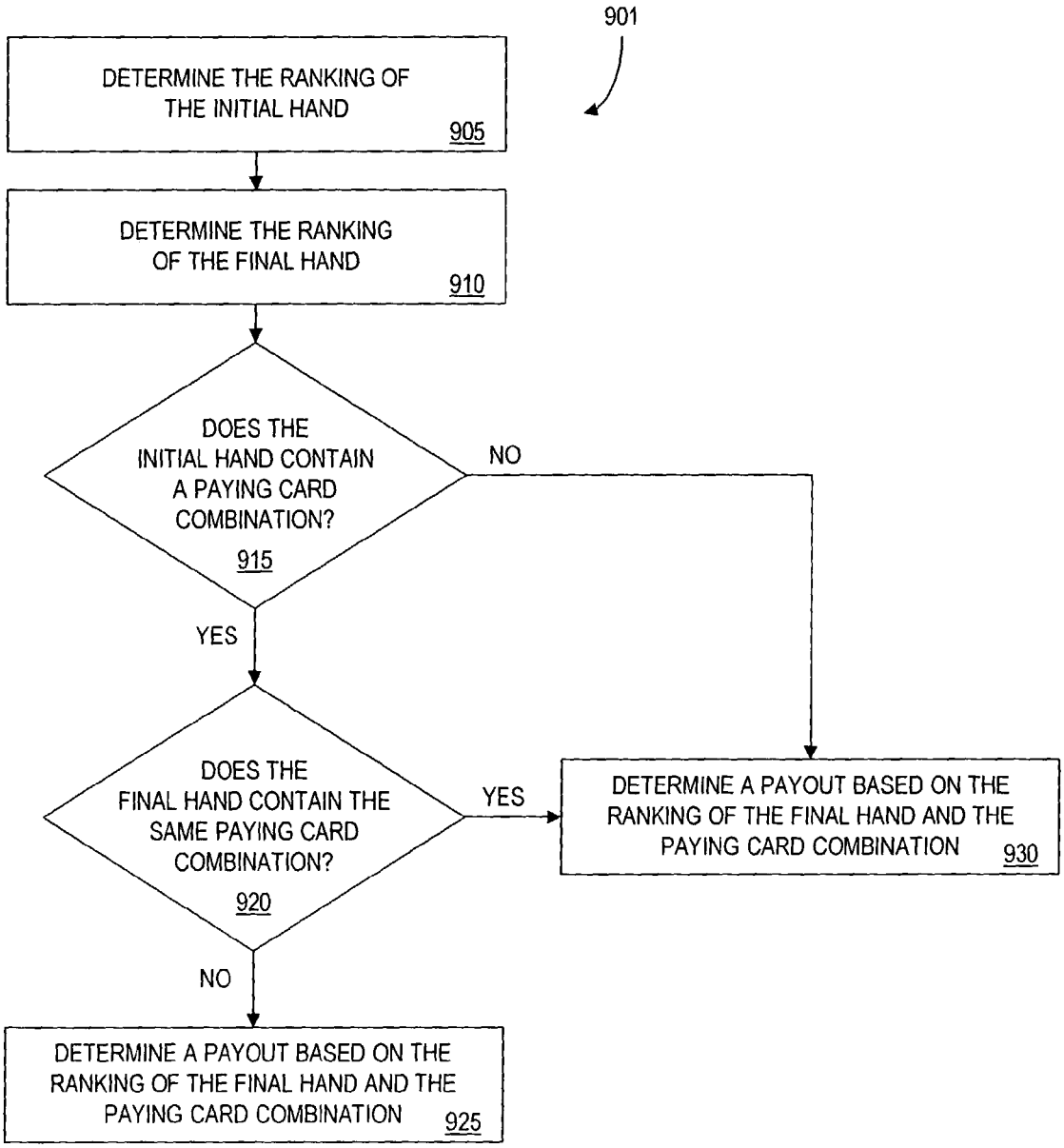
FIG. 9 is a flow chart illustrating a method for operating a video poker gaming device in accordance with one or more embodiments of the present invention.

Referring now to FIG. 9, a process 901 is described for determining a payout based on the initial hand and the final hand described in process 601 in accordance with one or more embodiments. Process 901 may be performed, for example, by CPU 102. At step 905, CPU 102 determines the ranking of the initial hand. At step 910, CPU 102 determines the ranking of the final hand. At step 915, CPU 102 determines whether the initial hand contains a paying card combination.

As used herein, a paying card combination is any first combination of cards that, when combined with any second combination of cards in order to complete a poker hand, regardless of what cards are in the second combination, would cause that poker hand to be a paying hand, i.e., a hand with a positive corresponding payout. For example, the card combination Qs Qh is a paying card combination because, when combined with any other three cards, say Js 3c 2d, the resulting hand has the ranking of at least "PAIR JACKS OR BETTER," and therefore has a positive payout. Note that the combination Qs Qh, when combined with a second combination 8s 8h 8c, yields a hand with the ranking of "FULL HOUSE," significantly higher than "PAIR JACKS OR BETTER." Additionally, the card combination Qs Qh 2c is a paying card combination even though the 2c is not particularly important to the combination. However, the card combination 7c 7h is not a paying combination since, for example, 7h 7c 3d 10d Jc pays nothing. The combination 7c 7h is not a paying combination even though there are some other card combinations with which it might be combined to yield a paying hand. For example, 7c 7h, when combined with 7c 10d Kh would yield a hand with the ranking of "THREE OF A KIND." Even so, 7c 7h is not a paying combination since a paying combination must be combinable with an arbitrary other combination of cards in order to yield a paying poker hand. In other words, a poker hand consisting of a first combination of cards that is a paying combination and an arbitrary second combination of cards must be a paying poker hand regardless of what particular card or cards are in the second combination of cards. Exemplary paying card combinations include: combinations with two cards of the same rank, where the two cards are each ranked J or higher; combinations with three cards of the same rank; combinations with five cards of the same suit; and combinations with five cards of consecutive rank.

Paying card combinations may be further classified into rankings that correspond to the minimum ranking such combinations would confer upon a poker hand in which they appeared. The classifications of paying card combinations may therefore correspond to the rankings of poker hands that provide positive payouts. Thus, the card combination Qs Qh may be classified as a "PAIR JACKS OR BETTER" combination. The card combination 2d 2h 4d 4d may be classified as a "TWO PAIR" combination, and so on.

There are many ways in which CPU 102 may perform the step 915 of determining whether the initial hand contains a paying card combination. For example, CPU 102 may examine individually every possible combination of two or more cards. The CPU 102 might therefore examine the first and second cards, then the first and third cards, then the first and fourth cards, and so on. The CPU 102 would thereby examine ten possible combinations of two cards, ten possible combinations of three cards, five possible combinations of four cards, and one possible combination of five cards. For each combination examined, the CPU 102 may determine whether the combination meets predetermined criteria for being a paying card combination. Exemplary criteria include, whether or not the card combination contains three cards of the same rank, whether or not the card combination contains five cards of the same suit, and so on. If the CPU 102 determines that one or more of the card combinations is a paying card combination, then the initial hand can be said to contain a paying card combination.

The CPU 102 may further determine the classification of the card combination as e.g., "PAIR JACKS OR BETTER," "TWO PAIR," etc. The CPU 102 may then store in memory the classification of the card combination. If, after examination of multiple card combinations, the CPU 102 determines that the initial hand contains more than one paying card combination, then the CPU 102 may store classification information for each of the paying card combinations.

Additionally, or alternatively, the CPU 102 may determine the paying card combination of the highest classification. In other words, the CPU may determine, the card combination that would produce a poker hand of the highest minimum ranking when combined with a random combination of cards to complete a poker hand. A card combination from a hand of poker of the highest minimum ranking may be determined in the following manner. First every combination of cards contained within the poker hand is determined. For example, in the poker hand 3s 3h 3d 9c Ks, there are thirty-one possible combinations of cards (or thirty-two if a combination of cards consisting of zero cards is counted). Such combinations of cards include: (i) the 3s; (ii) the 3h; (iii) the 3d; (iv) the 9c; (v) the Ks; (vi) the 3s 3h; (vii) the 3s 3d; (viii) the 3s 9c; (ix) the 3s Ks; and so on, with the last combination in this sequence being (xxxi) the 3s 3h 3d 9c Ks, or the entire hand. Second, for each of the combinations of cards determined, all possible hands of poker containing the card combination are determined. Thus, considering the card combination of 3s 3h 3d 9c, for example, there are 48 possible poker hands, including (i) 3s 3h 3d 9c 2c; (ii) 3s 3h 3d 9c 2d; (iii) 3s 3h 3d 9c 2h; (iv) 3s 3h 3d 9c 2s; (v) 3s 3h 3d 9c 3c; (vi) 3s 3h 3d 9c 4c; and so on. Third, for each card combination, the ranking of all associated poker hands is determined. Thus, considering again the combination 3s 3h 3d 9c, the ranking of (i) 3s 3h 3d 9c 2c is determined to be "THREE OF A KIND;" the ranking of (ii) 3s 3h 3d 9c 2d is determined to be "THREE OF A KIND;" the ranking of (v) 3s 3h 3d 9c 3c is determined to be "FOUR OF A KIND;" and so on. Fourth, the minimum possible ranking from among all the poker hands associated with a particular card combination is determined. Considering once again the card combination 3s 3h 3d 9c, the minimum ranking for all the associated poker hands is "THREE OF A KIND." Incidentally, many of the associated poker hands have this minimum ranking. Fifth, from among all card combinations with a minimum ranking for associated poker hands now determined, the card combination corresponding to the highest minimum ranking is determined. For example, the minimum ranking associated with the combination 3s 3h 3d 9c is "THREE OF A KIND." The minimum ranking associated with the combination 3s 3h is "HIGH CARD/LOW PAIR." The minimum ranking associated with the combination Ks is "HIGH CARD/LOW PAIR." As it happens, for the poker hand 3s 3h 3d 9c Ks, the card combinations associated with the highest minimum rankings are: (i) 3s 3h 3d with a minimum ranking of "THREE OF A KIND;" (ii) 3s 3h 3d 9c with a minimum ranking of "THREE OF A KIND;" (iii) 3s 3h 3d Ks with a minimum ranking of "THREE OF A KIND;" and (iv) 3s 3h 3d 9c Ks with a minimum ranking of "THREE OF A KIND." Thus, each of these four card combinations may be considered a card combination of the highest classification from the poker hand 3s 3h 3d 9c Ks. As will be appreciated, there are many other procedures available for determining, from a poker hand, a card combination of the highest classification.

As another example, suppose an initial hand is 6h 6d Qc Qs 2d. Then, one paying card combination contained within the initial hand is Qc Qs, with a classification of "PAIR JACKS OR BETTER." Another paying card combination contained within the initial hand is 6h 6d Qc Qs, with a classification of "TWO PAIR." The latter combination has the higher classification. Therefore, the CPU might determine 6h 6d Qc Qs to be the card combination of the highest classification within the initial hand. If an initial hand contains two or more paying card combinations of the same classification, e.g., 6h 6d Qc Qs and 6h 6d Qc Qs 2d, then the gaming device may determine which of two or more paying card combinations contains the fewest number of cards. For example, the combination 6h 6d Qc Qs has fewer cards than the combination 6h 6d Qc Qs 2d, so the gaming device may note the former as the card combination classified as "TWO PAIR" with the fewest number of cards.

One reason to note the card combination of a given classification with the fewest number of cards is that such a combination may be the most likely, of all combinations with similar classification, to appear in a final hand. For example, the combination 6h 6d Qc Qs from an initial hand is more likely to appear in a final hand than is the combination 6h 6d Qc Qs 2d, since the appearance of the latter implies the appearance of the former, but the appearance of the former does not imply the appearance of the latter.

If at step 915, the CPU 102 has determined that the initial hand contains a paying card combination, then flow proceeds to step 920 where the CPU 102 determines whether or not the final hand contains the same paying card combination. The CPU 102 may, for example, examine every possible combination of cards in the final hand and compare them to the paying combination of cards found in the initial hand. If there is a match, then the CPU 102 may determine that the final hand does contain the same paying card combination as does the initial hand. If the initial hand contained multiple paying card combinations, then the CPU 102 may determine for each paying card combination that was in the initial hand whether or not the same paying card combination is in the final hand.

In one or more embodiments the CPU 102 may determine whether the paying card combination of the highest classification from the initial hand appears in the final hand. In one or more embodiments, the CPU 102 may determine, from among the one or more paying card combinations in the initial hand with the highest classifications of any paying card combinations in the initial hand, whether the paying card combination with the fewest number of cards appears in the final hand. For example, suppose an initial had is Kc Ks Kd Js 9d. There are many paying card combinations contained within this initial hand. For instance, (i) Kc Ks, (ii) Kc Kd, (iii) Kc Ks Js, (iv) Kc Ks Kd, (v) Kc Ks Kd Js, and so on. However, among all the paying card combinations in the initial hand, those with the highest classifications would be classified as "THREE OF A KIND." Card combinations classified as "THREE OF A KIND" include: (i) Kc Ks Kd, (ii) Kc Ks Kd Js, (iii) Kc Ks Kd 9d, and (iv) Kc Ks Kd Js 9d. From among all the paying card combinations classified as "THREE OF A KIND," the highest classification among any paying card combination in the initial hand, the combination with the fewest number of cards is Kc Ks Kd. Therefore, in this example, the CPU 102 may determine whether Kc Ks Kd appears in the final hand.

Continuing reference is made to the flow chart of FIG. 9, for an embodiment in which there is a single paying card combination under consideration. The single paying card combination may be, for example, the only paying card combination that was present in the initial hand, the paying card combination in the initial hand that had the highest classification of all paying card combinations in the initial hand, the paying card combination from the initial hand with the fewest cards from among those combinations with the highest classification, or a randomly selected paying card combination from among all paying card combinations in the initial hand. It may be appreciated that other paying card combinations may also be considered. If at step 920, the CPU 102 determines that the paying card combination under consideration is contained in the final hand, then flow proceeds to step 930, where a payout is determined based on the ranking of the final hand. The payout may be determined using a standard pay table. For example, for a one-coin wager, eight hundred coins may be awarded for a ROYAL FLUSH, fifty for a STRAIGHT FLUSH, twenty-five for FOUR OF A KIND, nine for a FULL HOUSE, six for a FLUSH, four for a STRAIGHT, three for THREE OF A KIND, two for TWO PAIR, and one for a PAIR JACKS OR BETTER. Flow may also proceed to step 930 after step 915, if no paying card combination has been found in the initial hand.

Referring again to step 920, if the CPU 102 determines that the paying card combination under consideration is not contained in the final hand, then flow proceeds to step 925. At step 925, the CPU 102 determines a payout based on the ranking of the final hand and based on the paying card combination.

The payout determined at step 925 may be determined in a number of ways. In one embodiment, the payout is determined by reference to a database such as 9A00 depicted in FIG. 9A. Each record K-T of 9A00 represents a particular final hand ranking, such as "ROYAL FLUSH" for record K, or "STRAIGHT FLUSH" for record L. Each record includes nine fields, of which five fields, fields 9A13, 9A14, 9A16, 9A18, and 9A20, are shown. Each field (with the exception of field 9A13) represents a classification of a paying card combination. Field 9A13 represents an initial hand with a ranking of "HIGH CARD/LOW PAIR." Each field (other than 9A13) of each record stores a payout for a hand where the initial hand contained the corresponding paying card combination, and where the final hand had the corresponding final hand ranking but did not contain the corresponding paying card combination. For example, field 9A20 of record L stores a payout of $55 for a hand in which the final hand ranking is "STRAIGHT FLUSH" and where the initial hand, but not the final hand, contained a paying card combination with the classification of "STRAIGHT." An exemplary hand for which field 9A20 of record L applies is illustrated in FIG. 9A beginning with Initial Hand One 9A30, and concluding with Final Hand 9A32. Initial Hand One 9A30 consists of 6c 10d 9d 8d 7d. Final Hand 9A32 consists of Jd 10d 9d 8d 7d. It is apparent that Initial Hand One 9A30 contains a paying card combination consisting of all five cards in Initial Hand One. The paying card combination is a STRAIGHT. Examination of Final Hand 9A32 reveals that the paying card combination from Initial Hand One is not present in Final Hand. Namely, the 6c, which was part of the paying card combination in Initial Hand One, is absent from Final Hand. The card that has replaced the 6c in the Final Hand, the Jd, has resulted in a Final Hand ranking of "STRAIGHT FLUSH." Therefore, the payout 9A34 for the game involving Initial Hand One and Final Hand is determined by field 9A20 of record L, and comes out to $55.

The game defined by Initial Hand Two 9A40 and Final Hand 9A42 provides an illustrative comparison to the game defined by Initial Hand One and Final Hand. Both games end with the same Final Hand. However, Initial Hand Two, in contrast to Initial Hand One, has no paying card combinations. Therefore, the payout 9A44 for the game beginning with Initial Hand Two may be determined using field 9A13 of record L, and comes out to $50.

It should be understood that table 9A00 contains payout data that is only exemplary, and many other payouts are possible for each field of each record. No representation is made that table 9A00 is the best table in any sense, nor that such a table would even be profitable for the casino. In other versions of poker, a table such as 9A00 might include additional records corresponding to additional final hand rankings, such as "FIVE OF A KIND" or "FOUR ACES." Similarly, table 9A00 might include additional fields corresponding to additional classifications for paying card combinations. Furthermore, a table such as 9A00 might contain fewer records and fields if, for example, the table corresponds to a version of poker where fewer than the illustrated number of possible hand rankings are possible.

As depicted, table 9A00 illustrates a general trend of increasing payouts for a given final hand ranking as the classification of the corresponding paying card combination increases. For example, suppose a player has a final hand with a ranking of "FLUSH." The player is better off having had an initial hand containing a paying card combination with the classification of "THREE OF A KIND" than having had an initial hand containing a paying card combination with the classification of "TWO PAIR," provided, of course, that in both cases the paying card combination does not appear in the final hand. One rationale for this increasing trend in payouts is that a player is rewarded for the "bravery" shown by breaking a paying card combination in order to aim for an even better hand than that with which he started. If a player foregoes a guaranteed payout by discarding one or more cards from a paying card combination, then it is natural for a player to expect that he would be rewarded for his risk taking. Furthermore, the greater the guaranteed payout that a player foregoes, the greater the reward may be in some embodiments if the player does achieve a winning final hand.

Figure 10:
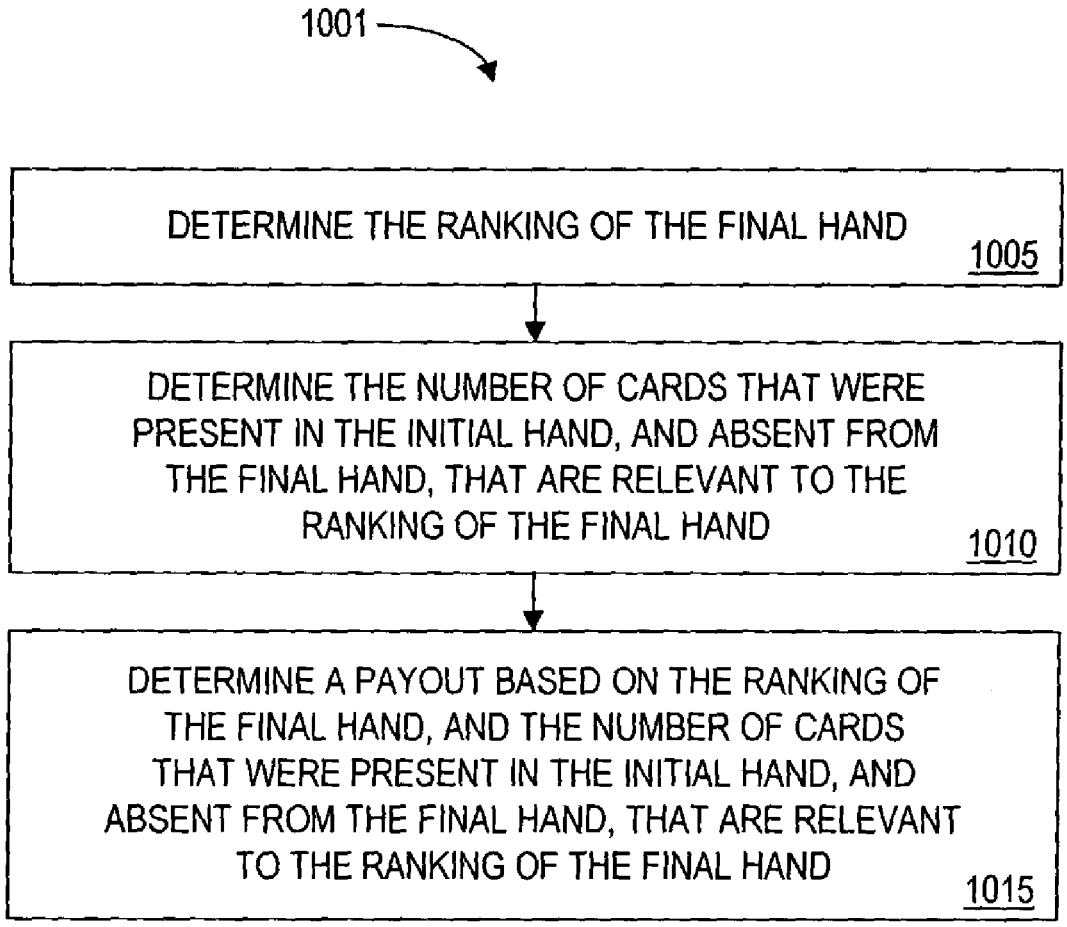
FIG. 10 is a flow chart illustrating a method for operating a video poker gaming device in accordance with one or more embodiments of the present invention.

Referring now to FIG. 10, a process 1001 is described for determining a payout based on the initial hand and the final hand described in process 601 in accordance with one or more embodiments. Process 1001 may be performed, for example, by CPU 102. At step 1005, CPU 102 determines the ranking of the final hand. At step 1010, CPU 102 determines the number of cards that were present in the initial hand, and absent from the final hand, that are relevant to the ranking of the final hand.

For example, suppose an initial hand is 10c 10d 9d 8d 3s. The 10c and 3s are discarded and then replacement cards 10h 10s are dealt to yield a final hand of 10h 10s 10d 9d 8d. The ranking of the final hand is therefore "THREE OF A KIND," since there are three tens. Now, three of the cards in the initial hand, the 10d 9d 8d, were contained in the final hand. However, two of the cards from the initial hand, the 10c and 3s, are not in the final hand. The question determined at step 1010 is then whether the 10c and/or 3s are relevant to the ranking of the final hand. Since the final hand has three tens, the 10c would have contributed to making three or even four tens, for possible rankings of "THREE OF A KIND" or "FOUR OF A KIND." On the other hand, the 3s would not have been relevant to the ranking of the final hand. Therefore, it may be determined for this example that one card that was present in the initial hand and absent from the final hand is relevant to the ranking of the final hand.

In various embodiments, one or more cards may or may not be considered as if they are relevant to the ranking of a final hand if whether the final hand is winning depends on the cards in the final hand for which the one or more cards would be substituted in. For example, suppose a final hand is Ks Qh 9d 7s 4c. In one embodiment, the Kd may be considered as if it is relevant to the ranking of the final hand. This is because if the Kd were substituted in for the Qh, 9d, 7s, or 4c, the final hand would now contain a pair of kings. However, if the Kd were substituted in for the Ks, the final hand would still not pay anything. Therefore, in some embodiments, the Kd may not be considered relevant, since there are some substitutions that would not result in the final hand being a paying hand. In another example, suppose the final hand is 9c 9d 2s 2h 8c. The card combination, 7h 7d, may be considered as if it is relevant in some embodiments, because substituting the 7h 7d in for the 2h 8c or the 9c 9d would yield a hand with a ranking of TWO PAIR. However, a substitution of the 7h 7d for the 9d 2s would result in a non-winning hand (i.e., 9c 7h 7d 2h 8c). Therefore, in some embodiments the card combination 7h 7d would not be considered as if it is relevant to the ranking of the final hand.

In one or more embodiments, one or more cards are only considered as if they are relevant to the ranking of the final hand if (i) the ranking of the final hand is "PAIR JACKS OR BETTER," "TWO PAIR," "THREE OF A KIND," "FULL HOUSE," or "STRAIGHT," and each of the one or more cards has the same rank (i.e., "9," "Q," etc.) as a card currently in and relevant to the ranking of the final hand; (ii) the ranking of the final hand is "FLUSH" and each of the one or more cards has the same suit (i.e. "spades," "hearts," etc.) as each of the cards in the final hand; (iii) the ranking of the final hand is "STRAIGHT" and each of the one or more cards forms a sequence of consecutively ranked cards with the cards currently in the final hand; or (iv) the ranking of the final hand is "STRAIGHT FLUSH," each of the one or more cards has the same suit as each of the cards in the final hand, and each of the one or more cards forms a sequence of consecutively ranked cards with the cards currently in the final hand. As a first example, suppose a final hand is Qs Qh 2d 9d Js. Then the Qd is relevant to the ranking of the final hand because, going by point (i), the final hand has a ranking of "PAIR JACKS OR BETTER," the Qd has the same rank (Q) as a card currently in the final hand (e.g., the Qs) and relevant to the ranking of the final hand (the Qs and Qh are relevant to the final hand since they form the pair in the final hand). However, the Jc would not have been relevant to the ranking of the final hand, because the Js in the final hand is not relevant to the ranking of the final hand. As a second example, suppose a final hand is Jd 10s 9c 8c 7h. The card combination 6h 5d is relevant to the ranking of the final hand, because, going by point (iii), the final hand has the ranking of "STRAIGHT" and the two cards in the card combination form a sequence of consecutively ranked cards with the cards currently in the final hand (i.e., J 10 9 8 7 6 5).

One motivation for basing a payout on the number of cards that were discarded from an initial hand, yet which are relevant to the ranking of a final hand, is that a hand similar to the final hand would have been more difficult to achieve given the cards that were discarded. For example, it would have been more difficult (i.e., unlikely) for a player to achieve a final hand with three queens if one of the cards that was discarded was a queen than if none of the cards that were discarded were queens. Thus, one or more embodiments of the present invention may reward a player for achieving a hand of a given character after the player's discard strategy had made the achievement of such a hand less probable than if the player had held one or more of the cards he discarded.

After step 1010, flow proceeds to step 1015, where the CPU 102 determines a payout based on the (i) ranking of the final hand, and the (ii) number of cards that were present in the initial hand, and absent from the final hand, that are relevant to the ranking of the final hand.

The payout determined at step 1010 may be determined in a number of ways. In one embodiment, the payout is determined by reference to a database such as 10A00 depicted in FIG. 10A. Each record K-T of 10A00 represents a particular final hand ranking, such as "ROYAL FLUSH" for record K, or "STRAIGHT FLUSH" for record L. Each record includes six fields, fields 10A14, 10A16, 10A18, 10A20, 10A22, and 10A24. Each field stores a payout corresponding to a particular number of cards present in the initial hand, and not present in the final hand, that are relevant to the ranking of the final hand. For example, field 10A18 of record K stores a payout of $8 for a final hand of the ranking "FLUSH" where two cards were present in the initial hand, and absent from the final hand, wherein the two cards are relevant to the ranking of the final hand.

FIG. 10A also illustrates two exemplary games of video poker. The first game begins with Initial Hand One 10A30, consisting of Ks Qs Js 9s 4h, and ends with Final Hand 10A32. The Final Hand 10A32 consists of Ks Qs Js 8s 2s. The second game begins with Initial Hand Two 10A40, consisting of Ks Qs Js 9d 4h, and ends with Final Hand 10A42. The Final Hands for the two games are identical, with each containing five spades for a ranking of "FLUSH." However, for the first game the payout is $7 10A34, and for the second game the payout is $6 10A44. Examination of the two initial hands reveals why the payouts are different. Initial Hand One 10A30 contains two cards, the 9s and 4h, that are not present in the Final Hand 10A32. One of these cards, the 9s, is relevant to the ranking of the Final Hand 10A32, since the Final Hand is a spade FLUSH and the 9s is a spade. The 4h would not have been relevant to the ranking of the Final Hand. The payout for the game beginning with Initial Hand One 10A30 can therefore be found in field 10A16 of record O in database 10A00. Initial Hand Two 10A40 also contains two cards, the 9d and 4h, that are not present in Final Hand 10A42. However, neither of those cards would be relevant to the ranking of the Final Hand. Therefore, there are no cards in Initial Hand Two, and not in Final Hand 10A42, that are relevant to the ranking of Final Hand 10A42. The payout for the game beginning with Initial Hand Two 10A40 can therefore be found in field 10A14 of record O in database 10A00.

Table 10A00 contains several records with "N/A" listed in one or more fields. For example, record Q has "N/A" listed under field 10A18. A particular field may not be applicable to a particular record if it is not possible for there to be, say, three cards that are relevant to the ranking of a final hand. For example, consider an embodiment where, in order to be considered as if it is relevant, a card must be of the same rank as a card currently in and relevant to a final hand. For example, suppose a final hand is 3s 3h 3c 9c 6s, with a ranking of "THREE OF A KIND." The only cards that are relevant to the ranking of the final hand are the 3s 3h and 3c. Therefore, in the embodiment under consideration, the only card that might be considered as if it is relevant to the ranking of the final hand is another three, i.e., the 3d. It follows that there could not be two cards that were present in the initial hand and absent from the final hand that are relevant to the ranking of the final hand, since there is only one 3d. That is why certain cells within pay table 10A00 show N/A. For instance field 10A18 of record Q has "N/A."

It should be understood that table 10A00 contains payout data that is only exemplary, and many other payouts are possible for each field of each record. No representation is made that table 10A00 is the best table in any sense, nor that such a table would even be profitable for the casino. In other versions of poker, a table such as 10A00 might include additional records corresponding to additional final hand rankings, such as "FIVE OF A KIND" or "FOUR ACES." Furthermore, a table such as 10A00 might contain fewer fields if, for example, the table corresponds to a version of poker where fewer than five cards can be drawn. Similarly, a table such as 10A00 may contain a greater number of fields for versions of poker where hands consist of more than five cards.

As depicted, table 10A00 illustrates a general trend of increasing payouts for a given final hand as the number of cards increases, wherein the number of cards represents the number of cards present in the initial hand, and absent from the final hand, that are relevant to the ranking of the final hand. For example, examining record R, corresponding to a final hand ranking of "TWO PAIR," the payout is $2 when there are zero cards 10A14 present initially, and absent from the final hand, that are relevant to the ranking of the final hand. However, when there is one card 10A16 present initially, and absent from the final hand, that is relevant to the ranking of the final hand, the payout goes up to $3. And the payout continues increasing as one proceeds to the right in table 10A00. One rationale for this increasing trend in payouts is that the trend may reflect a lower probability of achieving a hand of a given final ranking when cards that would have contributed to the final ranking were discarded from the initial hand. For instance, it is less probable to achieve a FLUSH in spades after having discarded two spades than it is after having discarded no spades. Similarly, it is less probable to achieve a hand with three tens after having discarded a ten, than after not having discarded a ten. Therefore, the increasing trend in payouts may provide a player with greater rewards for achieving increasingly improbable results.

Figure 11:
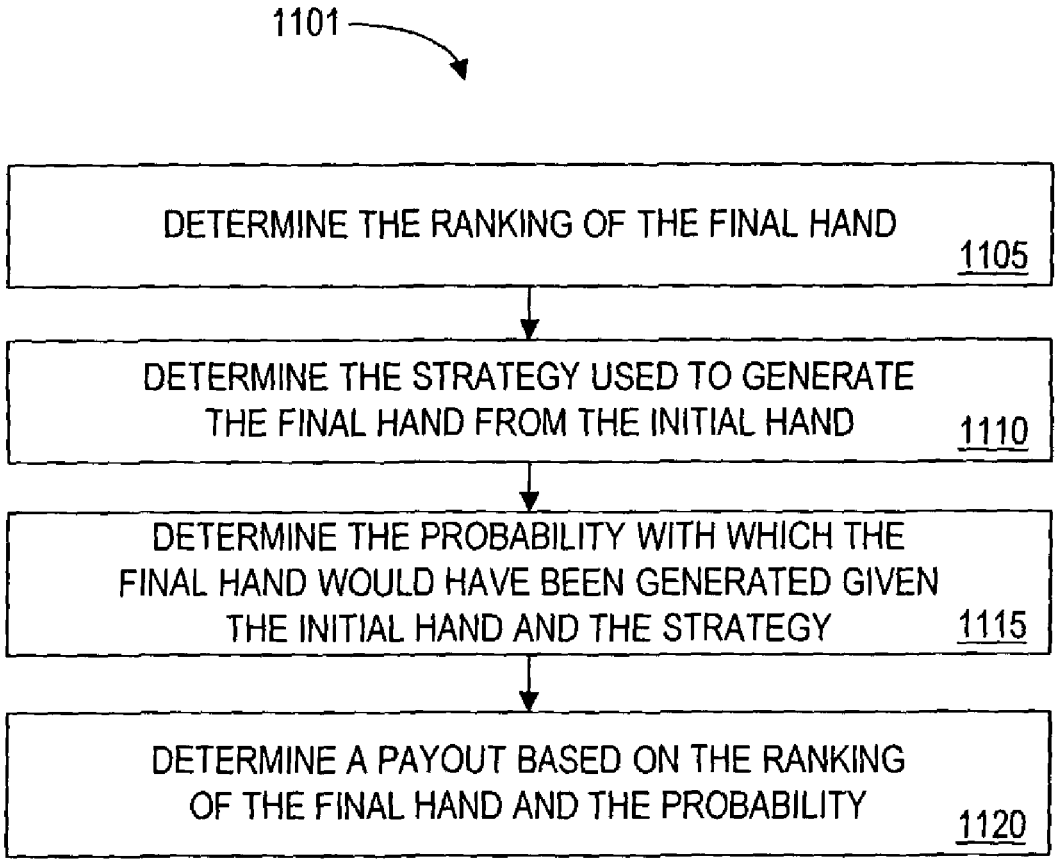
FIG. 11 is a flow chart illustrating a method for operating a video poker gaming device in accordance with one or more embodiments of the present invention.

Referring now to FIG. 11, a process 1101 is described for determining a payout based on the initial hand and the final hand described in process 601 in accordance with one or more embodiments. Process 1101 may be performed, for example, by CPU 102. At step 1105, CPU 102 determines the ranking of the final hand. At step 1110, CPU 102 determines the strategy used to generate the final hand from the initial hand. In one embodiment, the term "strategy" refers to the combination of cards from the initial hand that were discarded before generating the final hand. For example, one strategy is to discard only the card in the first position of the initial hand. Another example of a strategy is to discard only the cards in the second and fifth positions in the initial hand. A third example of a strategy is to discard all five cards in the initial hand. A fourth example of a strategy is to discard none of the cards in the initial hand. As will be appreciated, there can be thirty-two possible strategies, since there are five cards in an initial hand, and each strategy makes a binary decision for each of the five cards as to whether or not to discard it. Thus, there are $2^5$, or thirty-two possible strategies. It should also be noted that a strategy may be equivalently stated as the cards that will be held in an initial hand. For example, equivalent strategies are discarding the cards in the first and second positions of a hand, or of holding the cards in the third, fourth, and fifth positions of the hand.

Therefore, at step 1110, the gaming device may determine the positions from which cards in the initial hand were discarded. The gaming device may simply record which "hold" buttons or which "discard" buttons were pressed by the player. Alternatively, the gaming device may compare the cards in the final hand with the cards that had been in the initial hand. The gaming device may determine the positions in which cards differ between the two hands, and may thereby determine that the strategy was to discard cards from those positions.

At step 1115, the CPU 102 determines the probability with which the final hand would have been generated given the initial hand and the strategy. For example, if the strategy involved drawing zero cards, or equivalently holding all cards, then the final hand is guaranteed to have occurred given the initial hand and the strategy. Therefore, for a strategy involving drawing zero cards, the CPU 102 may determine a probability of one at step 102. If the strategy involved drawing one card, then the probability of achieving the final hand given the strategy and the initial hand is the probability with which the replacement card that was actually dealt would have been expected to be dealt. For example, suppose an initial hand is 9s 9d Kh Kc 8s. The 8s is discarded and the replacement card that is dealt is the Jd, yielding a final hand of 9s 9d Kh Kc Jd. The question determined at step 1115 is then what was the a priori probability of achieving the hand 9s 9d Kh Kc Jd given the initial hand 9s 9d Kh Kc 8s and the player strategy of discarding the 8s. The question reduces to: what was the a priori probability of drawing the Jd? To determine the probability of drawing the Jd, it may be noted that, from a deck of fifty-two cards, five cards had already been dealt to form the initial hand. Therefore, forty-seven cards remained in the deck, one of which was the Jd. Therefore, the a priori probability of drawing the Jd was 1/47, or approximately 0.0213 ($2.13\times10^{-2}$).

In other versions of video poker, the probability of drawing the Jd may be different. For example, if a video poker game is played with a large deck of cards consisting of five standard decks, then there are originally 5×52=260 cards, of which there are five Jd's. After the initial hand, there are two hundred fifty-five cards remaining in the deck, of which five are the Jd. Therefore, the a priori chance of drawing the Jd is 5/255, or about 0.0196.

Returning now to a version of video poker in which only a single standard deck of cards is used, a strategy involving the discarding of two cards is considered. When a final hand is achieved after drawing two new cards, the a priori probability of achieving such a final hand given the player's initial hand and strategy is again equivalent to the a priori probability of the two replacement cards being dealt. The probability of drawing two particular replacement cards from a deck with forty-seven cards remaining is equal to one divided by the number of possible two-card combinations that may be drawn. The number of possible two card combinations is equal to forty-seven choose two, or 47!/((47-2)!(2!))=1081. Therefore, the probability of drawing a particular two-card combination is 1/1081, or approximately $9.25\times10^{-4}$.

In some embodiments, a particular hand may be characterized not only by the cards contained therein, but also by the order of the cards. For example, some versions of video poker provide an extra reward for a ROYAL FLUSH in which the cards are in sequential order. In other words, As Ks Qs Js 10s may pay more than Ks As Qs Js 10s, since the cards are in sequential order only in the former hand. Therefore in some embodiments, a hand such as 8s 8h 8d 2c 6c may be considered different from 8s 8h 2c 8d 6c, even though both hands contain the same cards. In embodiments where order matters, the a priori probability of achieving a final hand given an initial hand and a player strategy would consider the number of possible permutations of cards that might be drawn from among the cards remaining in the deck. For example, suppose an initial hand is 8s 8h 8d 2c 6c. The player then chooses a strategy in which he discards the 2c and 6c. The replacement cards dealt then turn out to be Ks 3h, for a final hand of 8s 8h 8d Ks 3h. The number of permutations of two cards that may be drawn from a deck with forty-seven cards remaining is 47!/(47−2)!=47*46. The a priori probability of achieving the final hand 8s 8h 8d Ks 3h given the initial hand was therefore 1/(47*46), or approximately $4.63\times10^{-4}$.

Returning once again to a version of poker in which the order of cards in the final hand does not matter, a priori probabilities may be readily derived for final hands in which three, four, or five cards have been discarded from the initial hands. These probabilities are the inverse of forty-seven choose three (approximately $6.17\times10^{-4}$), of forty-seven choose four (approximately $5.61\times10^{-6}$), and of forty-seven choose five (approximately $6.52\times10^{-7}$), respectively.

Once the CPU 102 has determined the probability with which the final hand would have been generated given the initial hand and the strategy at step 1115, flow proceeds to step 1120. At step 1120, the CPU 102 determines a payout based on the ranking of the final hand and based on the probability determined at step 1115.

The payout determined at step 1120 may be determined in a number of ways. In one embodiment, the payout is determined by reference to a database such as 11A00 depicted in FIG. 11A. Each record K-T of 11A00 represents a particular final hand ranking, such as "ROYAL FLUSH" for record K, or "STRAIGHT FLUSH" for record L. Each record includes six fields, fields 11A14, 11A16, 11A18, 11A20, 11A22, and 11A24. Each field stores a payout corresponding to a particular a priori probability of achieving the final hand given the initial hand and the player's strategy. For example, field 11A22 of record Q stores a payout of $4 for a final hand of the ranking "THREE OF A KIND" where the probability with which the final hand would have been generated given the initial hand and the player strategy is approximately $5.61\times10^{-6}$.

FIG. 11A also illustrates two exemplary games of video poker. The first game begins with Initial Hand One 11A30 and ends with Final Hand 11A32. Initial Hand One 11A30 is As 10s 10h 10d 3c. Final Hand 11A32 is Qh 10s 10h 10d 10c. The second game begins with Initial Hand Two 11A40 and ends with Final Hand 11A42. Initial Hand Two 11A40 is As 8c 10h 10d 3c. The two Final Hands are identical. However, for the first game the payout is $28 11A34, and for the second game the payout is $33 11A44.

Examination of the two games reveals why the payouts are different. Stepping through game play process 1101 with reference to the two games depicted in FIG. 11A, it may first be determined at step 1105 that the ranking of both Final Hands is "FOUR OF A KIND," as both Final Hands have four tens. Proceeding to step 1110, it is evident through comparison of Initial Hand One 11A30 and Final Hand 11A32 that the player has discarded the first and fifth cards from Initial Hand One 11A30 in order to arrive at the Final Hand 11A32 after the dealing of the replacement cards Qh and 10c. Comparison of Initial Hand Two 11A40 and Final Hand 11A42 reveals that the player has discarded the first, second and fifth cards from Initial Hand Two 11A30 in order to arrive at the Final Hand 11A42 after the dealing of the replacement cards Qh, 10s, and 10c. Since the first game involved the dealing of two replacement cards, the probability of Final Hand 11A32 having occurred given Initial Hand One and the player strategy is 1/(47 choose 2), or approximately $9.25\times10^{-4}$. The payout for Final Hand 11A32 can therefore be found under field 11A18 of record M, for a payout of $28. Since the second game involved the dealing of three replacement cards, the probability of Final Hand 11A42 having occurred given Initial Hand Two and the player strategy is 1/(47 choose 3), or approximately $6.17\times10^{-5}$. The payout for Final Hand 11A42 can therefore be found under field 11A20 of record M, for a payout of $33.

It should be understood that table 11A00 contains payout data that is only exemplary, and many other payouts are possible for each field of each record. No representation is made that table 11A00 is the best table in any sense, nor that such a table would even be profitable for the casino. In other versions of poker, a table such as 11A00 might include additional records corresponding to additional final hand rankings, such as "FIVE OF A KIND" or "FOUR ACES." Furthermore, a table such as 11A00 might contain fewer fields if, for example, the table corresponds to a version of poker where fewer than five cards can be drawn. Similarly, a table such as 11A00 may contain a greater number of fields for versions of poker where hands consist of more than five cards.

As depicted, table 11A00 illustrates a general trend of increasing payouts for a given final hand ranking as the probability of achieving the final hand of a game given the initial hand and player strategy decreases. For example, examining record P, corresponding to a final hand ranking of "STRAIGHT," the payout is $3 when the probability of achieving the final hand given the initial hand and player strategy is one. However, when the probability of achieving the final hand given the initial hand and player strategy is decreased to $6.17\times10^{-5}$, the payout goes up to $5. This trend of increasing payouts may reflect a rationale of providing a player with greater rewards for more unlikely accomplishments. That is, when a player achieves a given final hand that was highly improbable given the player's initial hand and strategy, the player may receive a greater reward than if he had achieved the same final hand from an initial hand which would have made the final hand much more likely to occur. Providing greater rewards for more improbable accomplishments may be in keeping with player expectations. Furthermore providing greater rewards for more improbable accomplishments may provide an incentive for a player to pursue strategies which have a low chance of succeeding. Even though the rewards for such strategies may be great, the low chance of success for such strategies may result in a greater advantage for the casino.

Figure 12:
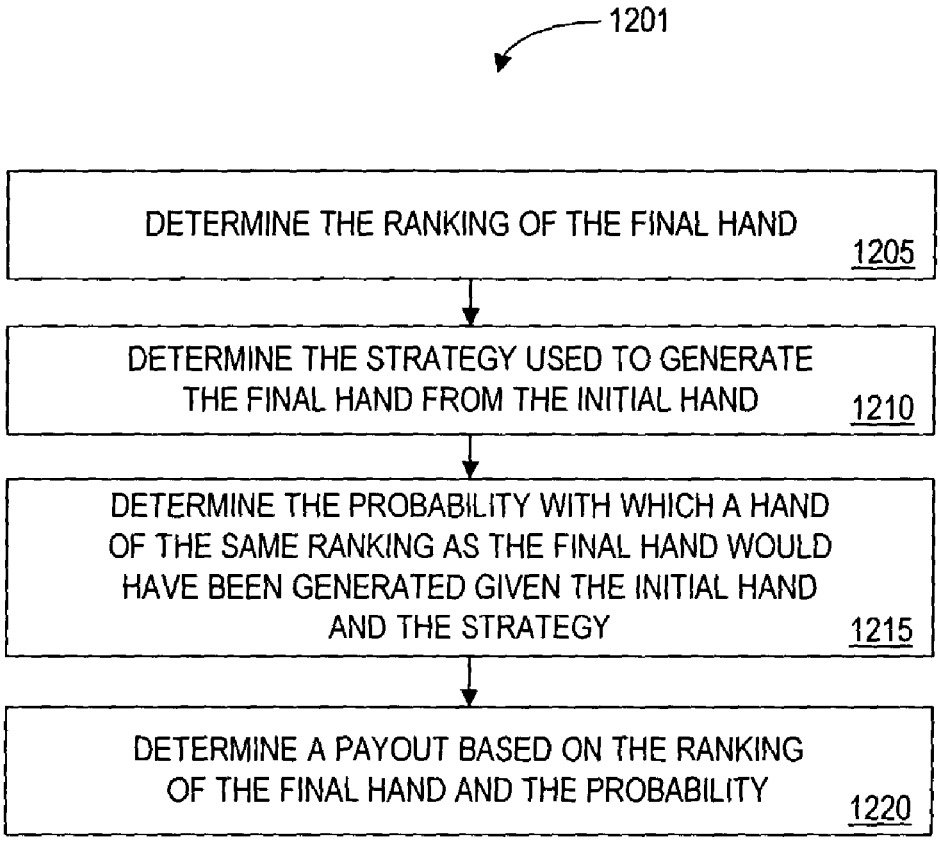
FIG. 12 is a flow chart illustrating a method for operating a video poker gaming device in accordance with one or more embodiments of the present invention.

Referring now to FIG. 12, a process 1201 is described for determining a payout based on the initial hand and the final hand described in process 601 in accordance with one or more embodiments. Process 1201 may be performed, for example, by CPU 102. Process 1201 is similar to that of process 1101, with steps 1205, 1210, 1215, and 1220 corresponding to steps 1102, 1110, 1115, and 1120. Therefore, process 1201 will not be described in as much detail as that of process 1101. However, step 1215 does merit some discussion, as it differs somewhat from step 1115.

At step 1215, CPU 102 determines the probability with which a hand of the same ranking as the final hand would have been generated given the initial hand and the strategy. Therefore, step 1215 considers the probability of generating any hand of the same ranking as the final hand, whereas step 1115 considered the probability of generating only the particular final hand that actually occurred. To further illustrate, suppose an initial hand is 4h 9h 10h Qh 9s. A player chooses to discard the 9s, and a replacement card of 3h is dealt, yielding a final hand of 4h 9h 10h Qh 3h (with a ranking of "FLUSH." Now, process 1101 would consider at step 1115 what the probability of generating the final hand 4h 9h 10h Qh 3h would have been given the initial hand 4h 9h 10h Qh 9s and the player strategy of discarding the 9s. However, process 1201 would consider at step 1215 what the probability of generating any hand of similar ranking to that of the final hand would have been (given the initial hand and player strategy). In other words, process 1201 would consider at step 1215 what the probability would have been of generating any FLUSH. As can be readily seen, the probability of generating any FLUSH given the initial hand will be much higher than the probability of generating one particular FLUSH.

The probability with which any hand of the same ranking as the final hand would have been drawn given the initial hand and player strategy may be determined in a number of ways. In one method, the CPU 102 may determine a first number equal to all possible card combinations the player may have drawn after discarding the chosen discards. Of all the possible card combinations, the CPU 102 may then determine a second number equal to all possible card combinations which would have led to a final hand of the same ranking as the final hand that actually occurred. The CPU 102 may then divide the second number by the first number to arrive at the probability to be determined in step 1215.

For example, suppose an initial hand is Ks Kh 10d 10c 8h. The player chooses to discard the 8h and then draws a 10s to make a final hand with a ranking of "FULL HOUSE." To determine what the probability would have been of making the FULL HOUSE given the initial hand and player strategy, the CPU 102 may first determine the number of card combinations that might have been drawn after the player discarded the 8h. Since there were then forty-seven cards remaining in the deck, the player might have drawn forty-seven possible card combinations to make a final hand. Of the forty-seven possible card combinations, only four would have made a FULL HOUSE. Those four card combinations are the 10s, 10h, Kd, and Kc. Therefore the probability with which the player would have drawn a final hand of a similar ranking to the final hand that actually occurred is 4/47, or approximately 0.085.

Of course, rather than calculate the probability directly, the CPU 102 may run Monte Carlo simulations where it simulates the generation of the final hand from the initial hand with many different orderings of the cards remaining in the deck.

The CPU 102 may thereby approximate a probability with which a hand of the same ranking as the final hand would have been generated given the initial hand and player strategy. Also note that, as with the process 1101, probabilities may depend on the particular version of video poker being played. For example, the probability of a final hand of a given ranking being generated given an initial hand and player strategy may differ depending on the number of decks in use.

The pay table illustrated in FIG. 12A is similar to that illustrated in 11A. However, in FIG. 12A, fields correspond to ranges of probability of achieving any hand of the same ranking as the final hand given the initial hand and the player's strategy. For example, field 12A16 would apply to any hand in which the probability of achieving the final hand given the initial hand and player strategy is between 0.3 and 1.0.

FIG. 12A also illustrates two exemplary games of video poker. The first game begins with Initial Hand One 12A30 and ends with Final Hand 12A32. Initial Hand One 12A30 is Ks Qs Js 9s 4h. Final Hand 12A32 is Ks Qs Js 8s 2s. The second game begins with Initial Hand Two 12A40 and ends with Final Hand 12A42. Initial Hand Two 12A40 is Ks Qs Js 9d 4h. The two Final Hands are identical. However, for the first game the payout is $7 12A, and for the second game the payout is $6 12A44.

Examination of the two games reveals why the payouts are different. To begin with, the ranking of Final Hands 12A32 and 12A42 may readily be determined to be "FLUSH," since all cards are spades. In the game beginning with Initial Hand One 12A30, it can be seen that the player strategy involved discarding the 9s 4h, after which he received replacement cards of 8s 2s. After the player discarded the 9s 4h, there were nine spades remaining in the deck (thirteen original spades less the spades contained in Initial Hand One). To achieve a hand with a final ranking of "FLUSH" the player needed to draw two additional spades from the nine spades remaining. The number of card combinations involving two spades was therefore nine choose two, or thirty-six. However, of those thirty-six card combinations, one would actually yield a hand of a higher ranking than that of the Final Hand 12A32. That is, if the player had drawn the As 10s, the player would have achieved a ROYAL FLUSH. Therefore, thirty-five possible card combinations would have led to a FLUSH. The total number of two-card card combinations was forty-seven choose two, or one thousand eighty-one. Therefore, the a priori probability of the player having achieved any hand of the same ranking as the final hand (e.g., any FLUSH) given the initial hand and player strategy was 35/1081, or approximately 0.0324. The probability of 0.0324 falls within the probability range of 0.03 to 0.035, corresponding to field 12A22 in payout table 12A00. The relevant record is record O. The payout is then found to be $7.

Examining now the game beginning with Initial Hand Two 12A40, it can be seen that after having discarded the 9d and 4h, the player now had ten spades remaining in the deck (the original thirteen spades less the three contained in Initial Hand Two) from which to draw a two-card combination. There are ten choose two, or forty-five possible combinations of two spades. However two of those combinations would lead to a final hand with a, ranking higher than that of Final Hand 12A42. The As 10s would lead to a ROYAL FLUSH, and the 10s 9s would lead to a STRAIGHT FLUSH. Therefore, there are forty-three possible combinations of two spades that would have led to a final hand with a ranking of "FLUSH." The a priori probability of such a hand was therefore 43/1081, or approximately 0.0398. The probability of 0.0398 falls within the probability range of 0.035 to 0.04, corresponding to field 12A20 in payout table 12A00. The relevant record is record O. The payout is then found to be $6.

It should be understood that table 12A00 contains payout data that is only exemplary, and many other payouts are possible for each field of each record. No representation is made that table 12A00 is the best table in any sense, nor that such a table would even be profitable for the casino. In other versions of poker, a table such as 12A00 might include additional records corresponding to additional final hand rankings, such as "FIVE OF A KIND" or "FOUR ACES." Furthermore, a table such as 12A00 might contain any number of fields, depending on desired ranges of probability to which one or more payouts would correspond.

As depicted, table 12A00 illustrates a general trend of increasing payouts for a given final hand ranking as the probability of achieving a final hand of a similar ranking to the given final given the initial hand and player strategy decreases. For example, examining record L, corresponding to a final hand ranking of "STRAIGHT FLUSH," the payout is $50 when the probability of achieving any hand of "STRAIGHT FLUSH" given the initial hand and player strategy is 1.0 12A14, and the payout is also $50 when the probability falls in the range of 0.3 to 1.0 12A16. However, payout is $55 when the probability of achieving a "STRAIGHT FLUSH" given the initial hand and player strategy is within the range 0.04 to 0.3 12A18 or 0.035 to 0.04 12A20. This trend of increasing payouts may reflect a rationale of providing a player with greater rewards for more unlikely accomplishments. That is, when a player achieves a final hand of a given ranking that was highly improbable given the player's initial hand and strategy, the player may receive a greater reward than if he had achieved a final hand of the same ranking from an initial hand which would have made the final hand with such a ranking much more likely to occur. Providing greater rewards for more improbable accomplishments may be in keeping with player expectations. Furthermore providing greater rewards for more improbable accomplishments may provide an incentive for a player to pursue strategies which have a low chance of succeeding. Even though the rewards for such strategies may be great, the low chance of success for such strategies may result in a greater advantage for the casino.

Figure 13:
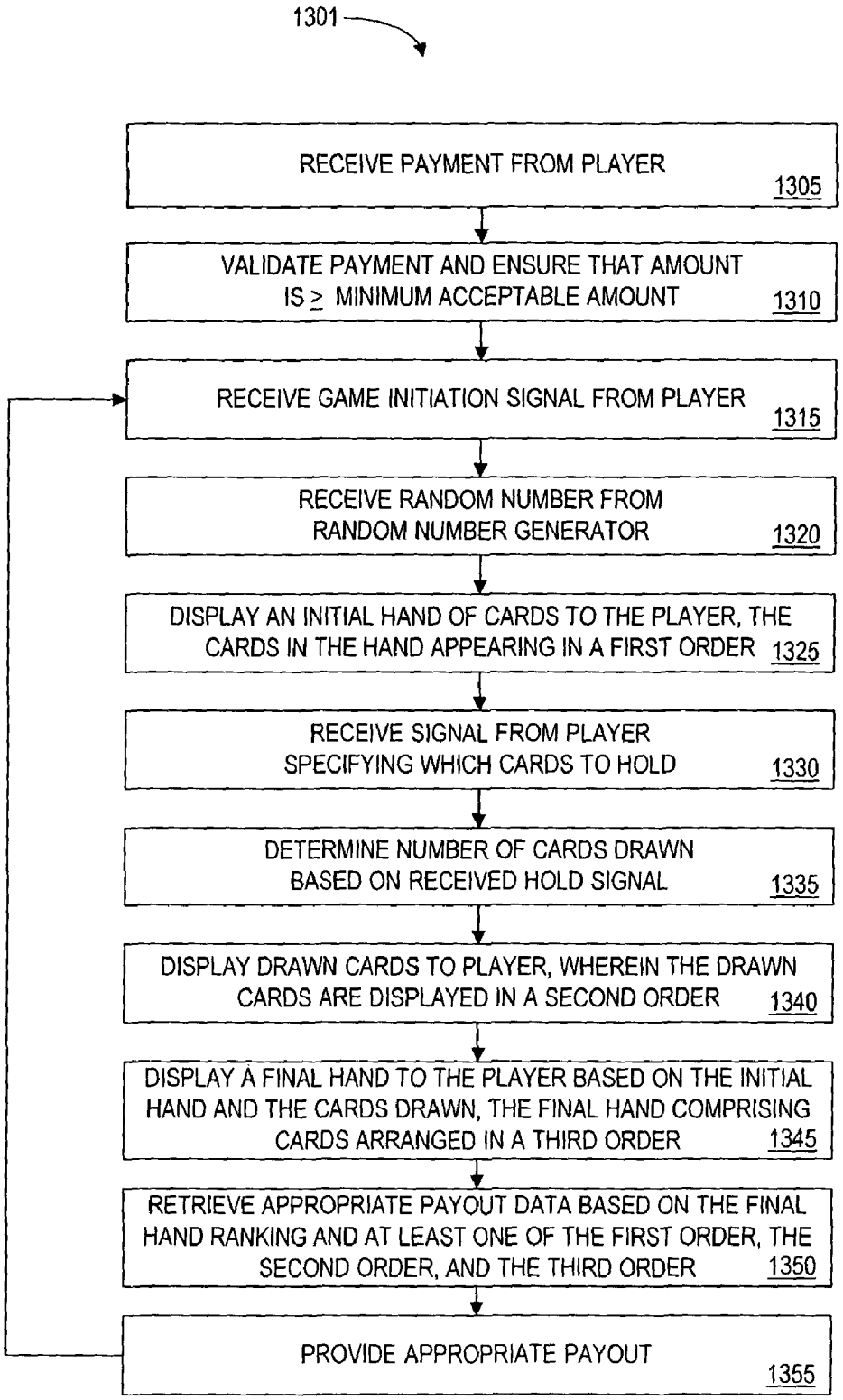
FIG. 13 is a flow chart illustrating a method for operating a video poker gaming device in accordance with one or more embodiments of the present invention.

Reference is now made to FIG. 13. FIG. 13 depicts another game play process 1301 that may be embodied by program 500 for operating a video poker gaming device in accordance with one or more embodiments of the present invention. Game play process 1301 parallels process 501 through steps 1305, 1310, 1315, and 1320. Steps 1305 through 1320 involve receiving a payment from a player, validating the payment and ensuring that the payment is greater than or equal to a minimum acceptable amount required for play, receiving a game initiation signal from the player and obtaining a random number from the random number generator.

Then, at step 1325, the CPU 102 determines an initial hand of cards. As before, the CPU 102 may determine the hand of cards by using the random number as a seed for ordering a deck of cards and by dealing the hand of cards from the top of the deck, as is well known in the art. At step 1325 the CPU also determines an ordering of cards in the initial hand of cards. The ordering of cards may correspond to the order with which the cards in the hand of cards were dealt from the deck. The ordering of the cards may also or equivalently indicate which cards in the hand of cards were displayed in which position of the initial hand. For example, the Jd was displayed in the first position, the Kd was displayed in the second position, and so on. The ordering of cards in the initial hand may be designated as a "first order."

At step 1330, the CPU 102 receives a signal from the player indicating which cards to hold. The CPU 102 may receive the signal via buttons labeled "hold" or "discard" that the player has pressed. As will be appreciated, there are many other ways by which CPU 102 may receive the signal. At step 1335, CPU 102 determines the number of cards drawn based on the hold signal. For example, if the player indicates that three cards should be discarded, then three replacement cards must be drawn. If the player indicates that two cards should be held, then the remaining three cards in the initial hand will be discarded, and again three replacement cards will be dealt.

At step 1340, CPU 102 causes the drawn cards to be displayed to the player. The drawn cards may initially be displayed separately from a final hand. At step 1340, CPU 102 may also determine an order for the drawn cards. Once again, the order of the drawn cards may correspond to the order in which they were dealt from the deck. The CPU 102 may note, for example, that the 8s was the first drawn card, the 9s was the second drawn card, and so on. The ordering of the drawn cards may be designated a "second order."

Whether or not the drawn cards are initially displayed separately from the final hand, at step 1345 the final hand, including the drawn cards, may be displayed to the player. Again, CPU 102 may determine the ordering of the cards in the final hand. The ordering of the cards in the final hand may be designated a "third order."

At step 1350, the CPU 102 determines the ranking of the final hand, and retrieves appropriate payout data based on the final hand ranking and at least one of the first order, the second order, and the third order. For example, the payout provided for a game may vary based not only on the ranking of the final hand, but also based on the ordering of the cards in the initial hand, the group of drawn cards, or the final hand.

The payout determined at step 1350 may be determined in a number of ways. In one embodiment, the payout is determined by reference to a database such as 13A00 depicted in FIG. 13A. Each record K-T of 13A00 represents a particular final hand ranking, such as "ROYAL FLUSH" for record K, or "STRAIGHT FLUSH" for record L. Each record includes five fields, fields 13A14, 13A16, 13A18, 13A20, and 13A22. Each field stores a payout corresponding the number of cards that occurred in the initial hand in ascending rank order from left to right. For example, the cards 5c 7s and Jd are in ascending rank order from left to right because J is a higher rank than seven, and seven is a higher rank than five. Because a number of groups of cards within the initial hand may occur in ascending rank order, the fields in table 13A00 refer only to the largest such group. For example, suppose an initial hand of cards is 6s 3s 9c Kd 8s. In this hand, the group of cards consisting of the 6s 9c Kd occurs in ascending rank order from left to right. The group of cards consisting of the 3s 9c Kd also occurs in ascending rank order from left to right, as does the group of cards consisting of the 3s 8s. However, the largest of these groups, of which there are several in this case, contain three cards occurring in ascending order going from left to right. Therefore, the payout for the 6s 3s 9c Kd 8s would be found under record T and field 13A18 of table 13A00. According to the table 13A00, the payout is $0.

FIG. 13A also illustrates two exemplary games of video poker. The first game begins with Initial Hand One 13A30 and ends with Final Hand 13A32. Initial Hand One 13A30 is 3h 7h 9c Qs Ad. Final Hand 13A32 is Jd 7c As Ah Ad. The second game begins with Initial Hand Two 13A40 and ends with Final Hand 13A42. Initial Hand Two 13A40 is 9c 7h Qs 3h Ad. The Final Hands are identical. Both have a ranking of "THREE OF A KIND," since both contain three aces. However, for the first game the payout is $4 13A34, and for the second game the payout is $2 13A44. Examination of the two initial hands reveals why the payout is different. Initial Hand One 13A30 contains a group of five cards that is in ascending rank order from left to right. In other words, the 3h 7h 9c Qs and Ad are in ascending rank order in Initial Hand One 13A30. Therefore, the payout for Initial Hand One 13A30 can be found in field 13A22 of record Q, resulting in a payout of $4. Initial Hand Two 13A40 contains at its largest a group of only three cards in ascending rank order from left to right. In other words, the 9s Qs Ad, or the 7h Qs Ad are in ascending rank order from left to right. But there are no groups of cards containing more than three cards that are in ascending rank order from left to right in Initial Hand Two 13A40. Therefore, the payout 13A44 for Initial Hand Two 13A40 can be found in field 13A18 of record Q, resulting in a payout of $2.

It should be understood that table 13A00 contains payout data that is only exemplary, and many other payouts are possible for each field of each record. No representation is made that table 13A00 is the best table in any sense, nor that such a table would even be profitable for the casino. In other versions of poker, a table such as 13A00 might include additional records corresponding to additional final hand rankings, such as "FIVE OF A KIND" or "FOUR ACES." Furthermore, a table such as 13A00 might contain fewer fields if, for example, the table corresponds to a version of poker where fewer than five cards are contained within a hand. Similarly, a table such as 13A00 may contain a greater number of fields for versions of poker where hands consist of more than five cards.

As depicted, table 13A00 tends to pay relatively more for a game with a given final ranking when the largest group of cards in the initial hand consists of only a few cards in ascending rank order (e.g., one or two), or relatively many cards in ascending rank order (e.g., four or five). Table 13A00 tends to pay relatively less for a given final hand when the initial hand had a largest group of cards in ascending rank order consisting of three cards. Note that only a few cards in ascending rank order would typically imply that there are relatively many cards in descending rank order. For example, in the hand Ks 10s 9s 6c 2d, the largest group of cards in ascending rank order is only one. However, all five cards in the hand are arranged in descending rank order. Thus, table 13A00 rewards the size of groups of cards in descending rank order as much as it rewards groups of cards in ascending rank order.

One rationale for providing greater payouts to hands with relatively many, or relatively few cards arranged in ascending rank order is that it is relatively unlikely for a given group of cards dealt at random to occur in ascending or descending rank order. For example, a group of five cards, each of different ranks, and placed in random order, has only a one in one hundred twenty chance of resulting in the cards occurring in ascending rank order. Similarly, the group of cards has only a one in one hundred twenty chance of resulting in all five cards occurring in descending rank order. Players may expect to be rewarded, or may appreciate being rewarded for accomplishments that are unlikely. Furthermore, in embodiments where a reward is based on the ordering of cards in the final hand, a player may alter his strategy in order to attempt to achieve a final hand in which the cards will be ordered in a desired manner. Such a shift in player strategy may provide the casino with an advantage.

It should be noted that while table 13A00 bases payouts on the ordering of cards in an initial hand, payouts may also be based on the ordering of cards in the final hand, and/or upon the ordering of drawn cards. Payouts may also be based on the order in which a player selected cards to discard from the initial hand (e.g., the order in which a player pressed one or more buttons indicating cards to discard from the initial hand). Payout may additionally be based on the order in which a player selected cards to hold form an initial hand. Furthermore, there may be many different criteria for considering cards to be ordered. For example, a group of cards may be considered ordered if cards of a first suit always occur first, cards of a second suit always occur after cards of the first suit, cards of a third suit always occur after cards of the second suit, etc. Cards may also be considered ordered if all suited cards occur before all non-suited cards, or vice versa. Cards may also be considered ordered if no three adjacent cards within the group are in ascending rank order (e.g., rank goes up from the first to the second card, down from the second card to the third card, up from the third card to the fourth card, and down from the fourth card to the fifth card). As will be appreciated, there are many other criteria by which cards may be considered ordered.

In one or more embodiments, one or more cards may assume multiple different ranks for ordering purposes. For example, an ace may assume a rank below a two, or above a K, depending on which is most beneficial (or least beneficial) to a player. Similarly, if there are wild cards, the wild cards may assume a rank that is most, or least beneficial to a player. In some embodiments, a card must assume for ordering purposes the rank that is used in determining the ranking of the final hand. For example, if a final hand is As 3h 9d Ah Js, then the hand will receive a ranking of "PAIR JACKS OR BETTER." Since the As was used for its rank above a king in evaluating the hand ranking, the As must also be used for its rank above a king in determining the number of cards in ascending rank order in the final hand. Therefore the exemplary hand contains a largest group of only three cards in ascending rank order, left to right.

In one or more embodiments, a payout may be determined based on a comparison of a first order of a set of cards (e.g., the set of cards in a final hand), and based on a second order of the same set of cards. An order may be assigned to a set of cards through the association, with each card within the set of cards, of an integer. For a set of five cards, the integers "one" "two," "three" "four," and "five" may be used. For example, a first order may be assigned to the cards in the hand 6c 9d Js 5h Jc by assigning the integer "one" to the 6c, the integer "two" to the 9d, the integer "three" to the Js, the integer "four" to the 5h and the integer "five" to the Jc. The first order thereby corresponds, for example, to the order of the cards within the hand, and/or to the order in which the cards were dealt. A second order may also be assigned to the same hand consisting of the 6c 9d Js 5h Jc. In the second order, the integer "one" may be assigned to the 5h, the integer "two" to the 6c, the integer "three" to the 9d, the integer "four" to the Js and the integer "five" to the Jc. The second order may thereby correspond to the rank order of the cards within the hand. As the Js and the Jc have the same rank, the assignment of integers to them may be determined based on an established hierarchy of suits (e.g., spades comes before clubs).

Once a set of cards has been assigned two different orders, the orders may be compared. For example, a subset of cards may be determined such that each of the cards within the subset of cards is associated with the same integer in either of the two orders assigned to the set of cards. Using the prior example, the Jc was the only card that was associated with the same integer in both orders assigned to the set of five cards. In both cases, the Jc was associated with the integer "five." Thus, a payout might be based on the fact that only a single card from the set of cards (e.g., the original hand of five cards) was assigned to the same integer in both orders. Another comparison between two orders assigned to the same set of cards may be a determination of the number of times integers in a second order might be "swapped" amongst two cards, in order for the associations of the second order to match those of the first order. For example, if the 6c is associated with the integer "two" and the 5h is associated with the integer "one," then the integers may be swapped amongst the two cards. The result of the swap would be that the integer "one" would now be assigned to the 6c, and the integer "two" would now be assigned to the 5h. Using the prior example, the second order of cards would require three swaps to look like the first order. To illustrate, first the 5h swaps its associated "one" with the associated "three" of the 9d. Then, the Js swaps its associated "four" with the associated "three" of the 5h. Then, the 6c swaps its associated "two" with the associated "one" of the 9d. As a result of the three swaps, the 6c is now associated with "one," the 9d is associated with "two," the Js is associated with "three," the 5h is associated with "four," and the Jc is associated with "five," just as in the first order. The first order and the second order may thereby be said to differ by three swaps, and a payout may be made based on this difference of three swaps.

One or more embodiments of the present invention may consider one or more commonalities between an initial hand of cards and a final hand of cards in determining a payout for a game of video poker. For example, the payout may depend on the number of cards that are present in both the initial and final hands. For instance, the payout may be for a first amount if there are exactly two cards present in both the initial and final hands (each hand consisting of five cards total), and for a second amount if there are exactly three cards present in both the initial and final hands. In another example, a payout may depend on the number of cards of a given suit that are present in both the initial and final hands. For instance, a payout may be for a first amount if both the initial hands and final hands include two clubs, and the payout may be a second amount if both the initial and final hands include three clubs. The payout need not be dependent on whether e.g., three clubs from the initial hand are the same three cards as the three clubs from the final hand.

The foregoing embodiments have been described with reference to several flow charts, e.g., FIGS. 5, 6, 7, 8, 9, 10, 11, 12, and 13. Additionally, other methods consisting of two or more steps have been suggested. It should be understood, however, that steps of the foregoing embodiments need not be performed in the order described. Rather, the steps of the foregoing embodiments may be performed in any order practicable. Furthermore, certain steps may be omitted from various embodiments, and certain steps may be added in various embodiments, without changing the spirit of the invention.

While various embodiments described herein are described with reference to a video poker gaming device, it is contemplated that other electronic gaming devices and methods of operating the same may be used in according with the teachings of this disclosure.

It is further contemplated that the embodiments described herein may be practiced by and/or in conjunction with on-line, or Web-based casinos. For instance, an on-line casino may maintain a server that hosts Web pages operable to receive wagers from a player, generate hands of video poker, and/or make payouts in accordance with one or more embodiments of the present invention. A player may place wagers, make decisions of what cards to hold from an initial hand, and request cashouts using a personal computer (PC), cell phone, personal digital assistant (PDA), or any other device capable of communicating with an on-line server. The player may provide funds for wagers by furnishing the on-line casino with a credit card number or other financial account number, and by authorizing the on-line casino to deduct funds from the account.

It is further contemplated that the embodiments described herein may be practiced by and/or in conjunction with a software program. Such a software program may be executable on e.g., a personal computer, a cell phone, a PDA, or on any other device. A software program may allow a player to play a game of video poker in accordance with one or more embodiments of the present invention by using a keyboard, mouse, or other input device to indicate wagers, indicate hold cards, and request cashouts. The software program may be for amusement purposes only, and need not, for example, require the player to provide cash, tokens, or a credit card number. For instance, a player may purchase from a computer store a software program that allows him to play video poker according to one or more embodiments of the present invention. The player may then use "virtual" or "play" tokens of no value to play the game.

Various methods described herein are described as being performed by a video poker gaming device. However, the functionality ascribed to a video poker gaming device may, in one or more embodiments, be shared or fully assumed by one or more additional devices. Additional devices may include a casino network server that e.g., maintains communication links with one or more gaming devices. A casino network server may, for example, operate software that randomly shuffles electronic decks of cards, that deals electronic cards upon receiving a signal from a player and/or gaming device, that calculates a payout, and/or that determines the graphics to be displayed on a gaming device. A casino server may operate software that performs one or more other embodiments of the present invention. In embodiments involving a casino server, a gaming device, such as a video poker gaming device, may serve only as a "dumb terminal" that receives input from a player, and provides output to a player, but performs no substantial additional functions. However, in various embodiments, a gaming device may perform some functions while a casino server or other device performs other functions. For example, a gaming device may receive a random seed from the casino server, but may utilize the random seed to internally generate a random ordering of an electronic deck of cards. It will be appreciated that there are many other ways in which a gaming device and a casino server may share functionality in performing the steps of one or more embodiments of the present invention.

A gaming device may share functionality with a number of other devices. For example, a gaming device may share functionality with a server owned or operated by a party other than the party who owns the gaming device (e.g., owned by a party other than a casino). A gaming device may share functionality with one or more other gaming devices. A gaming device may also share functionality with a player device, such as a PDA. For example, the gaming device may determine cards to be dealt a player, and may determine a payout for a player, but the player's PDA may actually display the hand of cards to the player, and the amount to be paid the player. There are many other devices with which a gaming device may share functionality. In addition, a gaming device may share functionality with more than one other device.

Various embodiments described herein make reference to data storage. For instance, various embodiments describe the storage of payout data, in which a payout is associated with e.g., an aspect of an initial hand and an aspect of a final hand. FIGS. 3, 7A, 8A, 9A, 10A, 11A, 12A, and 13A, illustrate exemplary payout tables that may be stored in a data storage device (e.g., data storage device 104) of the gaming device. However, it should be understood that data need not be stored solely with the gaming device. Rather, other devices, such as a casino server, a server operated by a third party, or a player device, may store data. Other devices may store some or all of the data that has been described in the foregoing embodiments. For example, all payout tables may be stored with a casino server. Alternatively, the casino server may store a first portion of a payout table (e.g., a first subset of cells from the payout table), and the gaming device may store a second portion of the payout table (e.g, a second subset of cells from the payout table). There may or may not be duplication of stored data among various participating devices. When needed by the gaming device, data not stored by the gaming device may be communicated to the gaming device.

It should additionally be understood that data which has been described as being stored within a single table or database need not necessarily be stored in a single table or database. Rather, data may be distributed among any number of tables, databases, or areas of a computer or network memory. For instance, a gaming device may store payouts corresponding to a first set of final hands in a first table, and may store payouts corresponding to a second set of final hands in a second table. It should also be understood that data that has been described as being stored in separate tables or databases may be stored within a single table, database, or area of computer or network memory. For example, the tables described in FIGS. 9A and 10A may be combined into a single table.

In view of the foregoing, an electronic gaming device and method for operating the same has been described in which a payout is determined based on a factor other than just the final hand ranking and wager amount. Determining the payout in this manner will make the game more interesting for players because they will be given the opportunity to execute a variety of complex and non-conventional games strategies and also will enable casinos to increase profits because the players will not be able to readily play perfect or near-perfect due to the increased complexity.

Although the particular embodiments shown and described above will prove to be useful in many applications relating to the arts to which the present invention pertains, further modifications of the present invention herein disclosed will occur to persons skilled in the art.

The invention claimed is:

1. A method of operating a gaming system comprising:

(a) accepting a wager from a player using an input device to start a play of a card game;

(b) causing a processor to execute a plurality of instructions to determine an initial hand of a plurality of cards from a deck of cards;

(c) causing a display device to display the initial hand;

(d) receiving from the player a selection of which, if any, cards of the initial hand to hold to form a set of held cards;

(e) causing the processor to execute the plurality of instructions to determine which cards, if any, of the initial hand are not selected to be held to form a set of discarded cards;

(f) when any cards are discarded from the initial hand, causing the processor to execute the plurality of instructions to, for each discarded card, randomly select a replacement card from the deck to display with the set of held cards to form a final hand;

(g) causing the display device to display the final hand; and (h) when any cards are discarded from the initial hand, causing the processor to execute the plurality of instructions to:

(1) determine whether the final hand results in a winning hand of a winning rank according to a first associated paytable, (2) if said final hand results in said winning hand, evaluate any discarded cards from said discarded set of cards to determine if any of said discarded cards could replace one of the cards in the winning hand to form a modified final hand of a modified final hand rank, wherein said modified final hand rank matches the winning rank of the winning hand, and (3) if any of the discarded cards could replace one of the cards in the winning hand to form said modified final hand of said modified final rank, determine how many of said discarded cards are in said modified final hand, and based upon the determination of how many discarded cards are in the modified final hand, provide an award to the player according to a different second associated paytable.

2. The method of claim 1, wherein the award provided to the player according to the second associated paytable is higher for each additional discarded card displayed in said modified final hand.

3. A method of operating a gaming system comprising:

(a) accepting a wager from a player using an input device to start a play of a card game;

(b) causing a display device to display an initial hand of a plurality of cards for the play of the card game;

(c) causing a processor to execute a plurality of instructions to enable a player to discard one or more cards of the initial hand;

(d) causing the display device to display a final hand for the play of the game, said final hand including:

(1) any cards not discarded from the initial hand, and (2) one or more replacement cards, wherein each discarded card is replaced with one of said replacement cards;

(e) causing the processor to execute the plurality of instructions to determine, independent of the discarded cards, whether the final hand is a winning hand of a winning rank;

(f) causing the processor to execute the plurality of instructions to determine if at least one of the discarded cards could replace one of the cards in the winning hand to form a modified final hand of a modified final hand rank, wherein said modified final hand rank matches the winning rank of the winning hand; and (g) if at least one of the discarded cards could replace one of the cards in the winning hand to form said modified final hand of said modified final rank, determining how many of said discarded cards are in said modified final hand, and based upon the determination of how many discarded cards are in the modified final hand, causing the processor to execute the plurality of instructions to provide an additional award to the player.

4. The method of claim 3, wherein the additional award provided to the player is higher for each additional discarded card included in said modified final hand.

* * * * *

UNITED STATES PATENT AND TRADEMARK OFFICE

CERTIFICATE OF CORRECTION

PATENT NO. : 7,867,073 B2
APPLICATION NO. : 10/430021
DATED : January 11, 2011
INVENTOR(S) : Walker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 993 days.

Signed and Sealed this
Seventh Day of June, 2011

David J. Kappos

David J. Kappos
*Director of the United States Patent and Trademark Office*